US011313136B2

(12) United States Patent
Ferris

(10) Patent No.: US 11,313,136 B2
(45) Date of Patent: Apr. 26, 2022

(54) SHOWER PAN INCLUDING MOLDED RIB STRUCTURE HAVING VARYING THICKNESS

(71) Applicant: Delta Faucet Company, Indianapolis, IN (US)

(72) Inventor: Jeffrey D. Ferris, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 287 days.

(21) Appl. No.: 16/731,798

(22) Filed: Dec. 31, 2019

(65) Prior Publication Data

US 2021/0198900 A1 Jul. 1, 2021

(51) Int. Cl.

| | |
|---|---|
| ***E04F 15/024*** | (2006.01) |
| ***E03F 5/04*** | (2006.01) |
| ***A47K 3/40*** | (2006.01) |

(52) U.S. Cl.

CPC ..... *E04F 15/02458* (2013.01); *A47K 3/40* (2013.01); *E03F 5/0408* (2013.01); *E04F 15/02405* (2013.01)

(58) Field of Classification Search

CPC ..... A47K 3/40; E04F 15/02458; E04F 15/02408; E03F 5/0408

USPC ..... 4/613

See application file for complete search history.

(56) References Cited

U.S. PATENT DOCUMENTS

| | | | |
|---|---|---|---|
| 4,140,828 | A | 2/1979 | Copping |
| 4,825,603 | A | 5/1989 | Hardwicke et al. |
| D308,578 | S | 6/1990 | Hillman |
| D323,322 | S | 1/1992 | Roland |
| 5,440,841 | A | 8/1995 | Greenfield |
| 6,519,902 | B1 | 2/2003 | Scissom |
| 6,799,403 | B2 | 10/2004 | Winter |
| 7,757,449 | B2 | 7/2010 | Portoles Ibanez et al. |
| 8,209,795 | B2 | 7/2012 | Cook |
| 8,857,109 | B1 | 10/2014 | Kirby |
| 9,234,351 | B1 | 1/2016 | Echelman |
| 2001/0052148 | A1 | 12/2001 | Hasenkopf |
| 2002/0166837 | A1 | 11/2002 | Gonzalez |
| 2005/0081290 | A1 * | 4/2005 | Stimpson ..... A47K 3/40 4/613 |
| 2005/0166508 | A1 | 8/2005 | MacLean et al. |
| 2008/0222797 | A1 | 9/2008 | Cook |
| 2010/0000169 | A1 | 1/2010 | Grave et al. |
| 2014/0317841 | A1 | 10/2014 | DeJesus et al. |
| 2014/0352810 | A1 | 12/2014 | Wedi |

(Continued)

FOREIGN PATENT DOCUMENTS

| | | |
|---|---|---|
| CN | 201840389 U | 5/2011 |
| CN | 201948898 U | 8/2011 |

(Continued)

OTHER PUBLICATIONS

Direct-to-Stud Bathtub installation instructions, Delta Faucet Company, Mar. 30, 2016.

*Primary Examiner* — Christine J Skubinna
(74) *Attorney, Agent, or Firm* — Bose McKinney & Evans LLP

(57) ABSTRACT

A molded shower pan includes a base having a drain opening. A plurality of strengthening ribs extend downwardly from the base wherein the spacing between adjacent ribs is a function of rib height.

23 Claims, 19 Drawing Sheets

(56) References Cited

U.S. PATENT DOCUMENTS

| | | | | |
|---|---|---|---|---|
| 2016/0015223 | A1* | 1/2016 | Cook | A47K 3/283<br>4/611 |
| 2016/0177561 | A1* | 6/2016 | DeJesus | E04B 1/6812<br>52/741.4 |
| 2019/0191932 | A1 | 6/2019 | Costello | |
| 2020/0157794 | A1* | 5/2020 | Self | E03C 1/22 |

FOREIGN PATENT DOCUMENTS

| | | | |
|---|---|---|---|
| CN | 107536522 | A | 1/2018 |
| CN | 107802198 | A | 3/2018 |
| DE | 20006667 | U1 | 6/2000 |
| JP | 0967922 | | 3/1997 |
| KR | 100371357 | | 1/2003 |
| KR | 100967792 | | 7/2010 |

* cited by examiner

SHOWER PAN INCLUDING MOLDED RIB STRUCTURE HAVING VARYING THICKNESS

BACKGROUND AND SUMMARY

The invention relates generally to shower floors and, more particularly, to a shower pan including a molded rib structure configured to accommodate varying thicknesses extending to a drain.

Molded shower floors or pans typically include a circular drain opening for receiving water. In order to reduce material for the purpose of molding and to improve strength, a grid or cell structure may be used on the lower surface of the shower pan. It is desired to provide a grid structure that accommodates varying shower pan thicknesses from a distal periphery to a proximal drain opening.

Illustratively, the shower pan of the present disclosure includes a body for use in a shower including a support wall or base and a drain opening formed within the base. A plurality of strengthening ribs extend downwardly from the base. The height of the ribs decrease as they extend from an outer periphery of the base toward the drain opening. As the height of the ribs decreases, the spacing between adjacent ribs also decreases. In the illustrative embodiment, the ribs are arranged in a plurality of different areas or zones, each having different relative spacing between adjacent ribs. More particularly, the illustrative rib structure includes a combination of several different sized rectangular rib zones, and an annular rib zone proximate the drain opening.

The illustrative shower pan of the present disclosure provides uniform resistance to bending when boundary geometry does not allow for uniform structure thickness. Variation in structure thickness means that the height of integral ribs will vary. An evenly spaced rib grid structure, with varying structure thickness will result in variation in the rigidity of the structure. Short ribs will bend more, while tall ribs will bend less under an equivalent load. The illustrative shower pan features optimized rib spacing and configuration to compensate for variation in structure thickness.

According to an illustrative embodiment of the present disclosure, a shower pan includes a body having a base defining a longitudinal axis, a first region, a second region continuous to, and distal of, the first region, and a third region continuous to, and distal of, the second region. The first region includes a drain opening extending through the base, the longitudinal axis extending through a center of the drain opening, a plurality of cells defined by a plurality of spaced-apart annular ribs, and a plurality of spaced apart radial ribs intersecting the annular ribs, wherein adjacent ones of the annular ribs are radially spaced apart by a first distance. The radial spacing between adjacent ones of the annular ribs is a function of the height of the annular ribs. The second region includes a plurality of second cells defined by a plurality of spaced-apart longitudinal ribs and a plurality of spaced-apart lateral ribs extending transverse to the longitudinal ribs, wherein adjacent ones of the lateral ribs are longitudinally spaced apart by a second distance. The longitudinal spacing between adjacent lateral ribs of the second region is a function of the height of the ribs of the second region. The third region includes a plurality of third cells defined by a plurality of spaced-apart longitudinal ribs and a plurality of spaced-apart lateral ribs extending transverse to the longitudinal ribs, wherein adjacent ones of the lateral ribs are longitudinally spaced apart by a third distance. The longitudinal spacing between adjacent lateral ribs of the third region is a function of the height of the ribs of the third region. The third distance is greater than the second distance, and the second distance is greater than the first distance.

According to a further illustrative embodiment, a shower pan includes a base including a substantially planar upper surface, a first region and a second region. The first region includes a drain opening extending through the base, a plurality of cells defined by a plurality of spaced-apart annular ribs extending downwardly from the base, and a plurality of spaced-apart radial ribs extending downwardly from the base and intersecting the annular ribs. The plurality of cells of the first region are concentrically positioned relative to the drain opening. The second region includes a plurality of cells defined by a plurality of spaced-apart longitudinal ribs extending downwardly from the base, and a plurality of spaced-apart lateral ribs extending downwardly from the base and transvers to the longitudinal ribs. The plurality of cells of the second region are polygons arranged in a rectilinear pattern. The spacing between the adjacent annular ribs of the first region is a function of the height of the ribs of the first region, and the spacing between adjacent lateral ribs of the second region is a function of the height of the ribs of the second region, such that the spacing of the ribs in the first region is less than the spacing of the ribs in the second region.

According to another illustrative embodiment of the present disclosure, a shower pan includes a first region having a drain opening, a plurality of spaced-apart annular ribs, and a plurality of spaced-apart radial ribs intersecting the annular ribs. The spacing between adjacent annular ribs is a function of the height of the ribs, such that the average spacing between adjacent annular ribs is substantially defined by the relationship of $l=C\ h^3$, wherein 1 is spacing between ribs, h is rib height, and C is a reference constant. The plurality of cells of the first region are concentrically positioned relative to the drain opening.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF DRAWINGS

A detailed description of the drawings particularly refers to the accompanying figures in which.

DETAILED DESCRIPTION OF THE DRAWINGS

Figure 1:
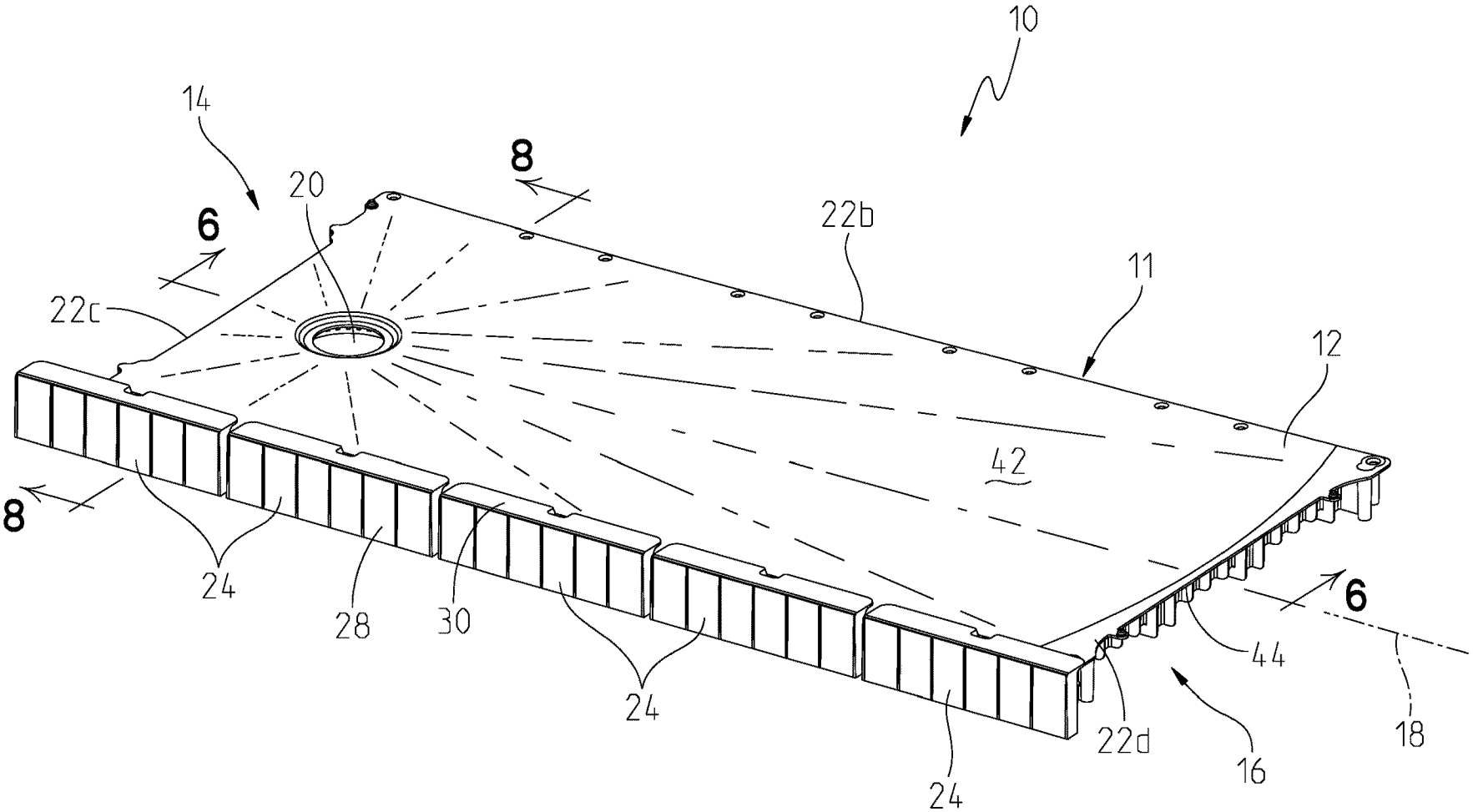
FIG. 1 is a top perspective view of an illustrative shower pan, showing a drain positioned near a proximal end and threshold forms positioned at a front edge.

For the purposes of promoting and understanding the principles of the present disclosure, reference will now be made to the embodiments illustrated in the drawings, which are described herein.

With reference initially to FIGS. 1-4, an illustrative shower floor or pan 10 is shown for use in a shower. The illustrative shower pan 10 includes a body 11 having a base or support wall 12 extending between a proximal end 14 and a distal end 16 along a longitudinal axis 18. A drain opening 20 is formed within the base 12 and is illustratively positioned along the longitudinal axis 18 near the proximal end 14. The base 12 includes a plurality of peripheral edges 22. In the illustrative embodiment, the peripheral edges 22*a*, 22*b*, 22*c*, 22*d* are linear to define rectangular base 12. Peripheral edges 22*a*, 22*b*, 22*c*, 22*d* of the illustrative embodiment include front edge 22*a*, rear edge 22*b*, left side edge 22*c* and right side edge 22*d*. It should be appreciated that the number, shapes and dimensions of the peripheral edges 22*a*, 22*b*, 22*c*, 22*d* may vary.

Figure 2:
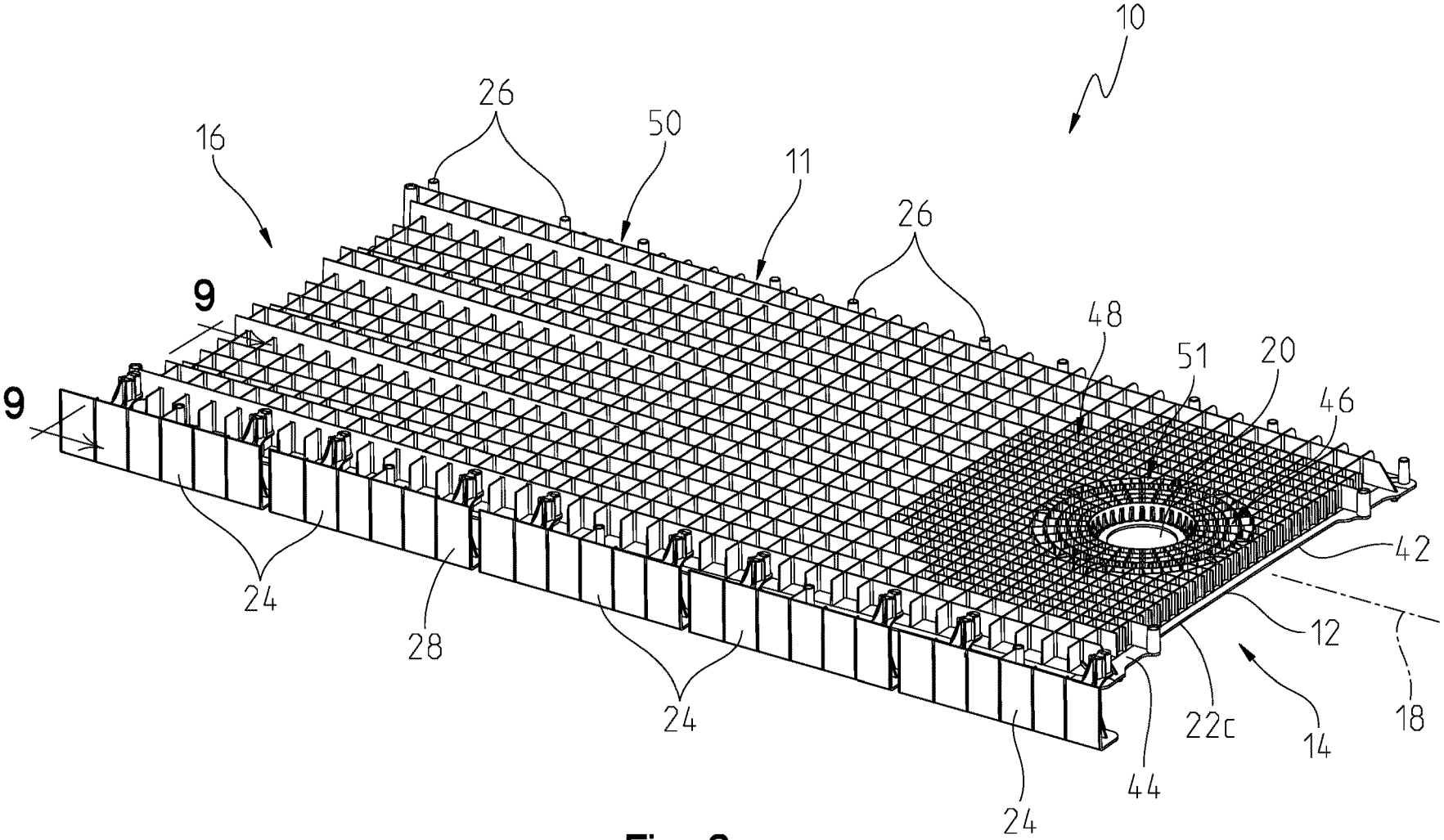
FIG. 2 is a bottom perspective view of the shower pan of FIG. 1.
Figure 3:
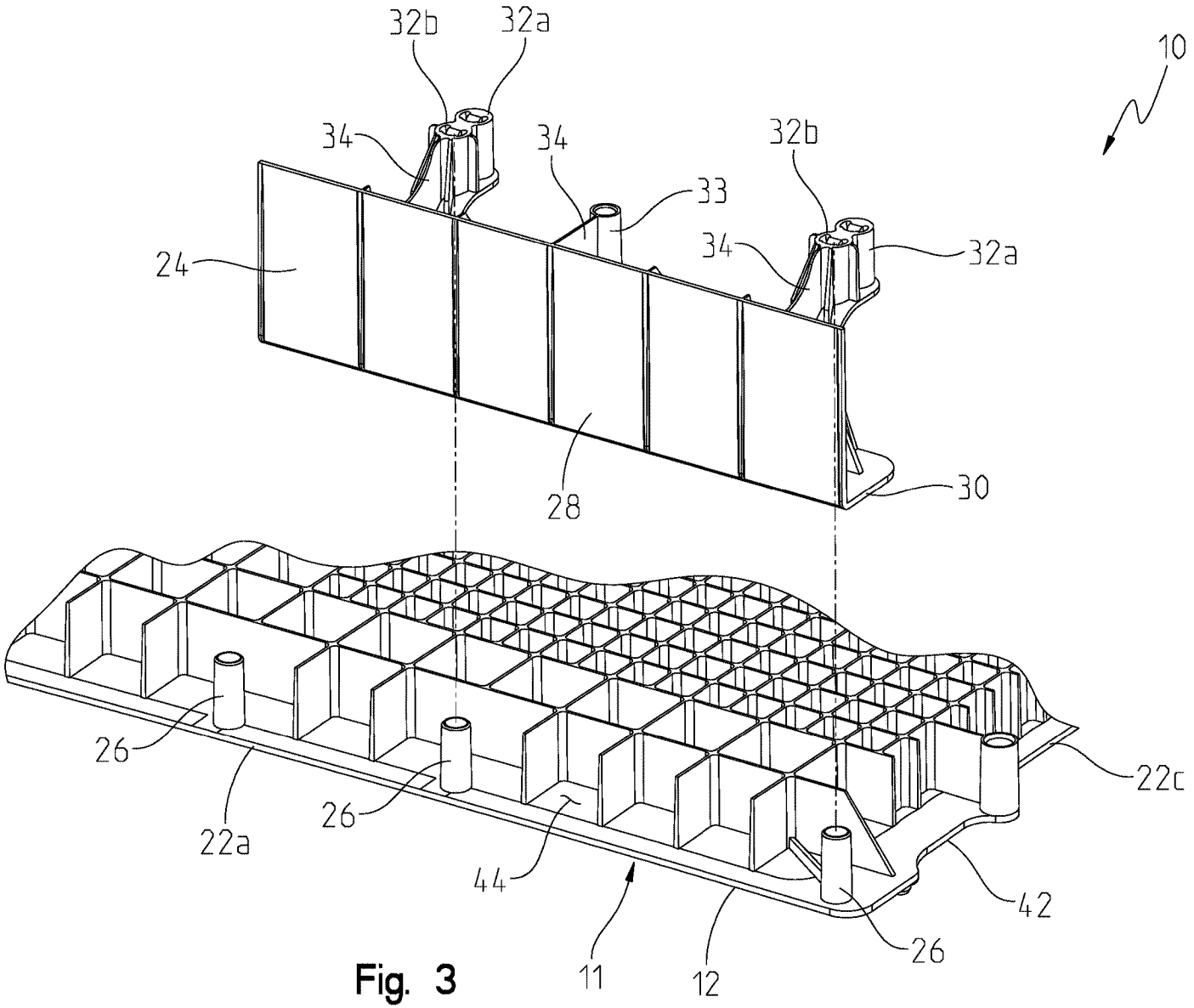
FIG. 3 is a partial exploded perspective view showing a threshold form removed from the base of the shower pan of FIG. 1.
Figure 9:
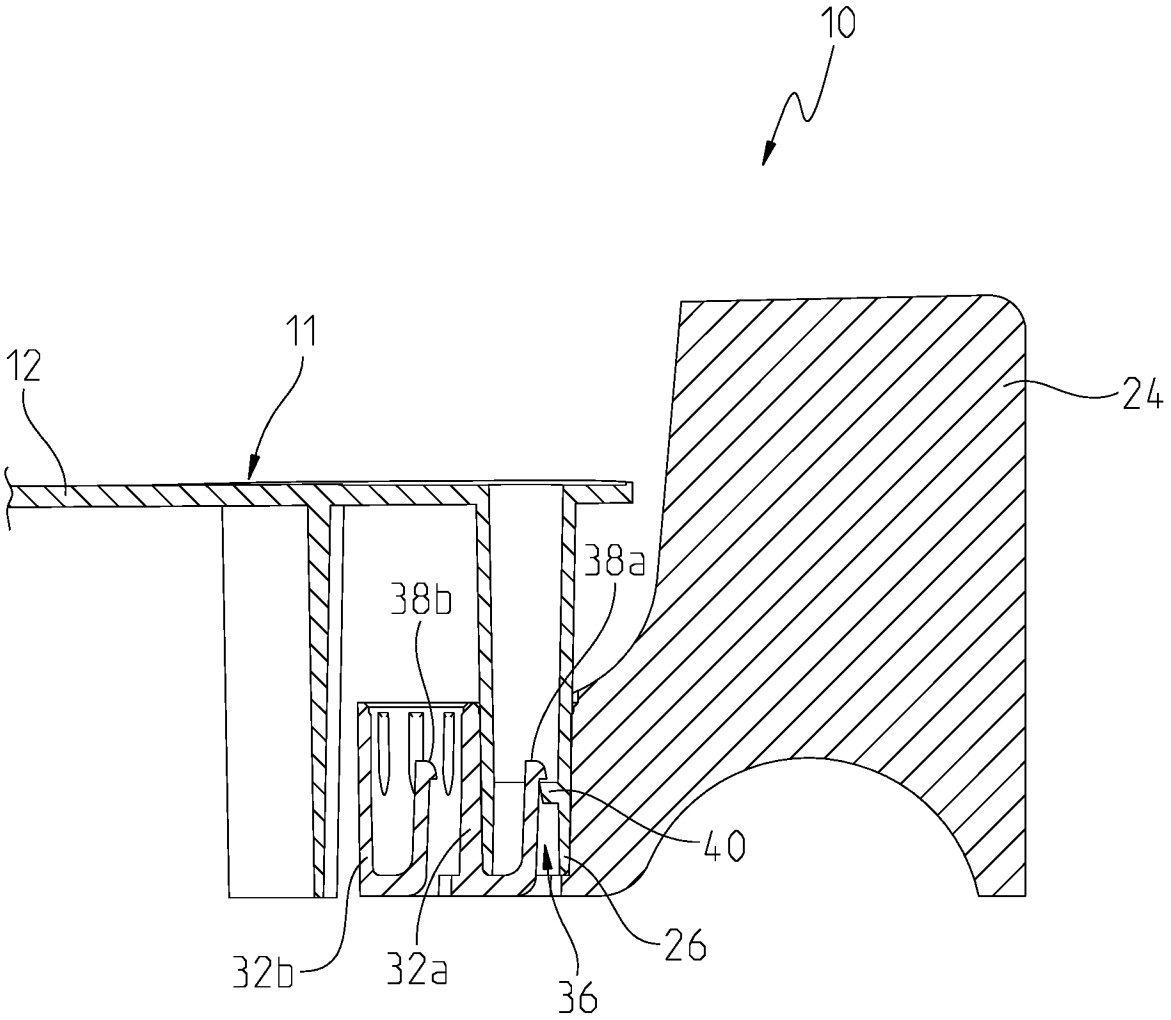
FIG. 9 is a detail view of the threshold form mounting of the shower pan of FIG. 8.

With reference to FIGS. 2, 3 and 9, a plurality of threshold forms 24 are illustratively supported by the front edge 22*a* of the base 12. As may be appreciated, the threshold forms 24 define an entry barrier for the shower pan 10. Illustratively, the base 12 includes a plurality of downwardly extending protrusions, illustratively hollow posts 26 positioned adjacent the front edge 22*a*. The threshold form 24 includes an outer side wall 28 and an upper wall 30. A plurality of cylindrical receivers 32 and 33 are coupled to the side wall 28 and the upper wall 30 by connecting webs 34. The receivers 32 and 33 are configured to receive posts 26 to couple the threshold form 24 to the base 12. As shown in FIG. 9, a retainer 36 may be associated with each receiver 32 to retain the threshold form 24 on the base 12. The illustrative retainer 36 may include a resilient clip 38*a*, 38*b* within the respective receiver 32*a*, 32*b* and configured to engage a tab 40 within the post 26.

In the illustrative embodiment, each threshold form 24 includes a plurality of laterally spaced receivers 32*a*, 32*b* supported by the web 34 to facilitate lateral positioning of the form 24 relative to the front edge 22*a* of the base 12. More particularly, the respective posts 26 may be received by either of the receivers 32*a*, 32*b* as desired for relative positioning of the threshold form 24 relative to the base 12. Such lateral positioning of the forms 24 may aid in installation of the shower pan 10 when different bases 12 are used and/or widths are desired.

The base 12 illustratively includes a substantially planar upper surface 42 and a lower surface 44 defining a plurality of zones or regions 46, 48, 50 and 51 defining a grid or cell structure. More particularly, the shower pan 10 illustratively includes a first zone or region 46 with the drain opening 20 extending between the upper surface 42 and the lower surface 44. A second zone or region 48 is illustratively contiguous to, and distal of, the first region 46. Similarly, a third zone or region 50 is illustratively contiguous to, and distal of, the second region 48. Illustratively, a transition zone or region 51 may extend between the first region 46 and the second region 48. The number, size and positioning of the regions 46, 48, 50, 51 may vary based upon, for example, the size and shape of the base 12 and the location of the drain opening 20.

Figure 4:
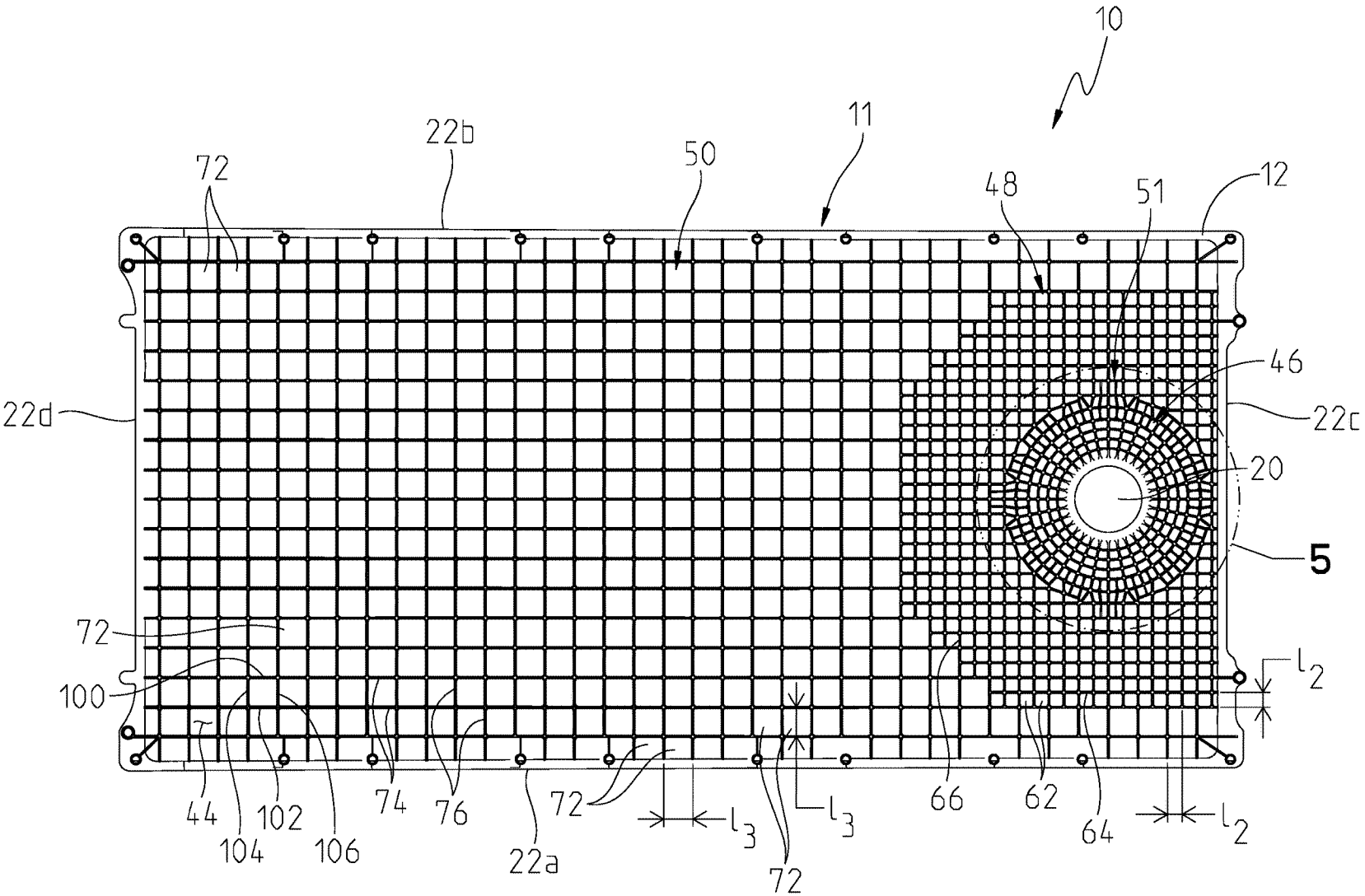
FIG. 4 is a bottom plan view of the shower pan of FIG. 1.
Figure 5:
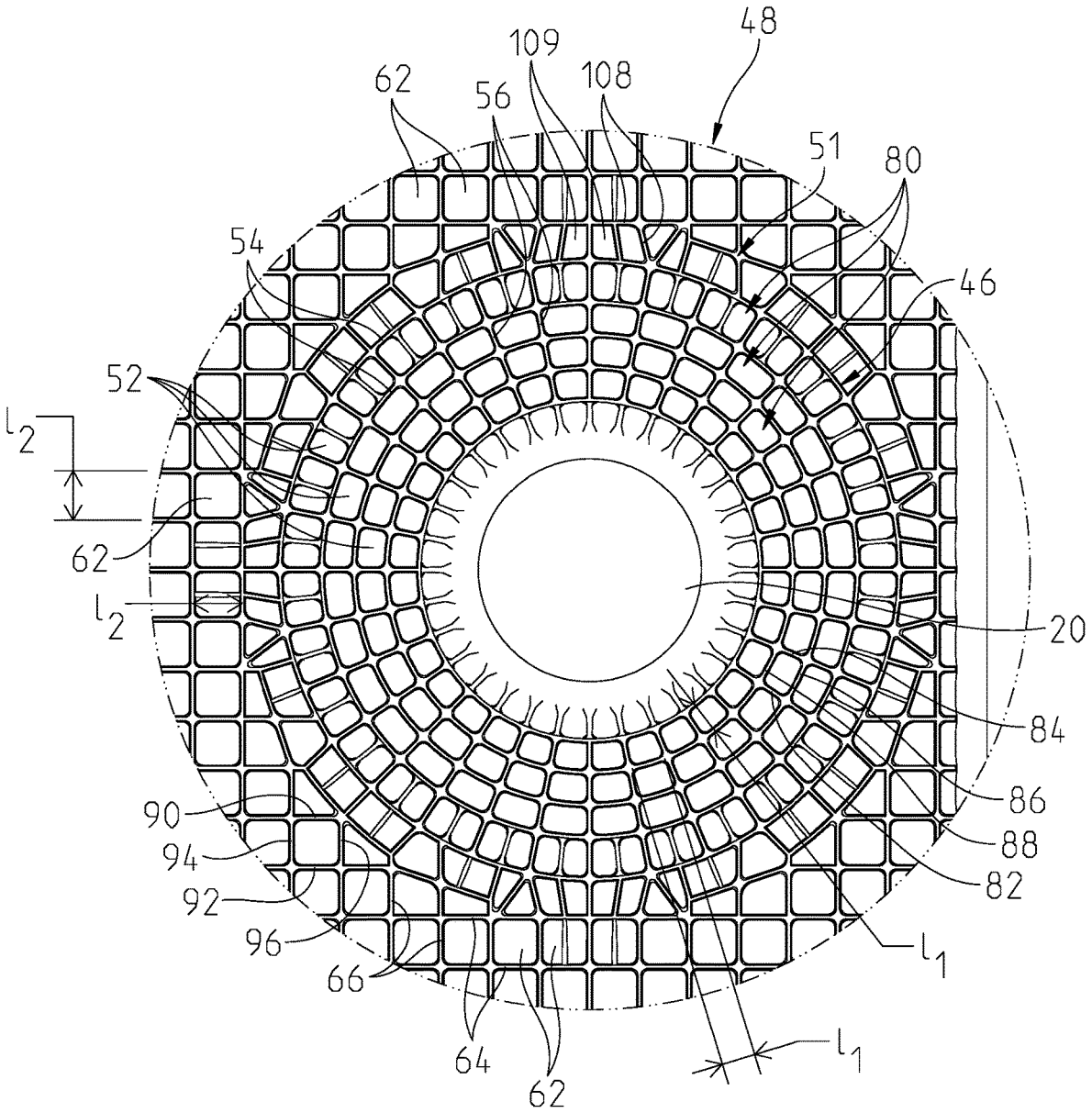
FIG. 5 is a detail view of FIG. 4.
Figure 7:
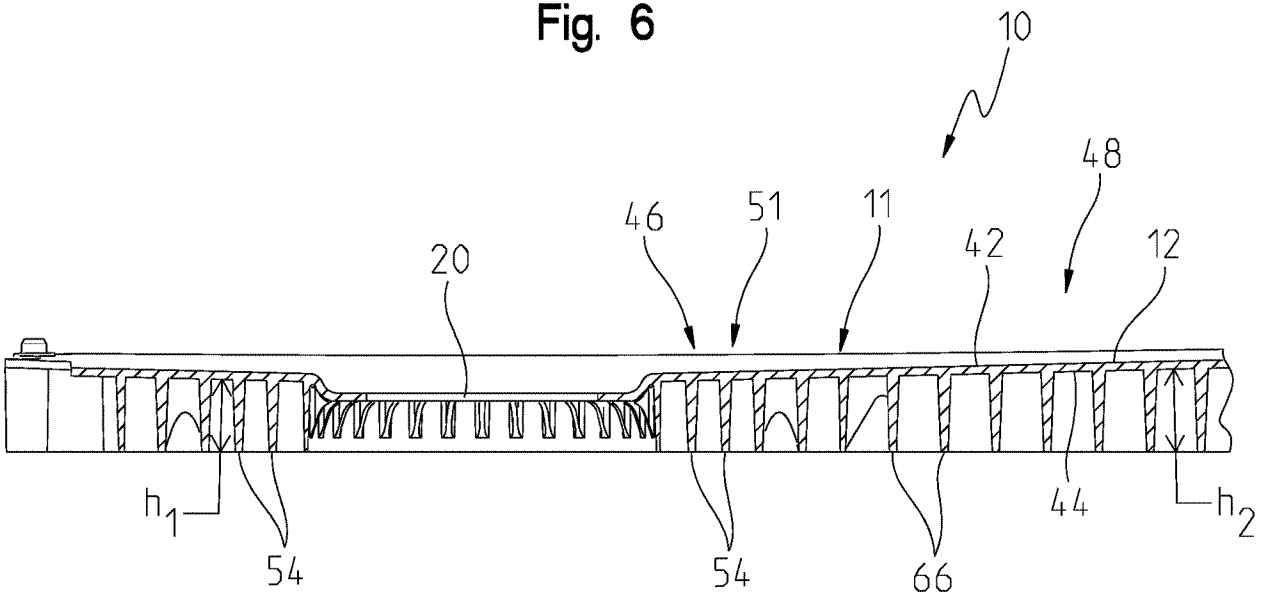
FIG. 7 is a detail view of FIG. 6.
Figure 8:
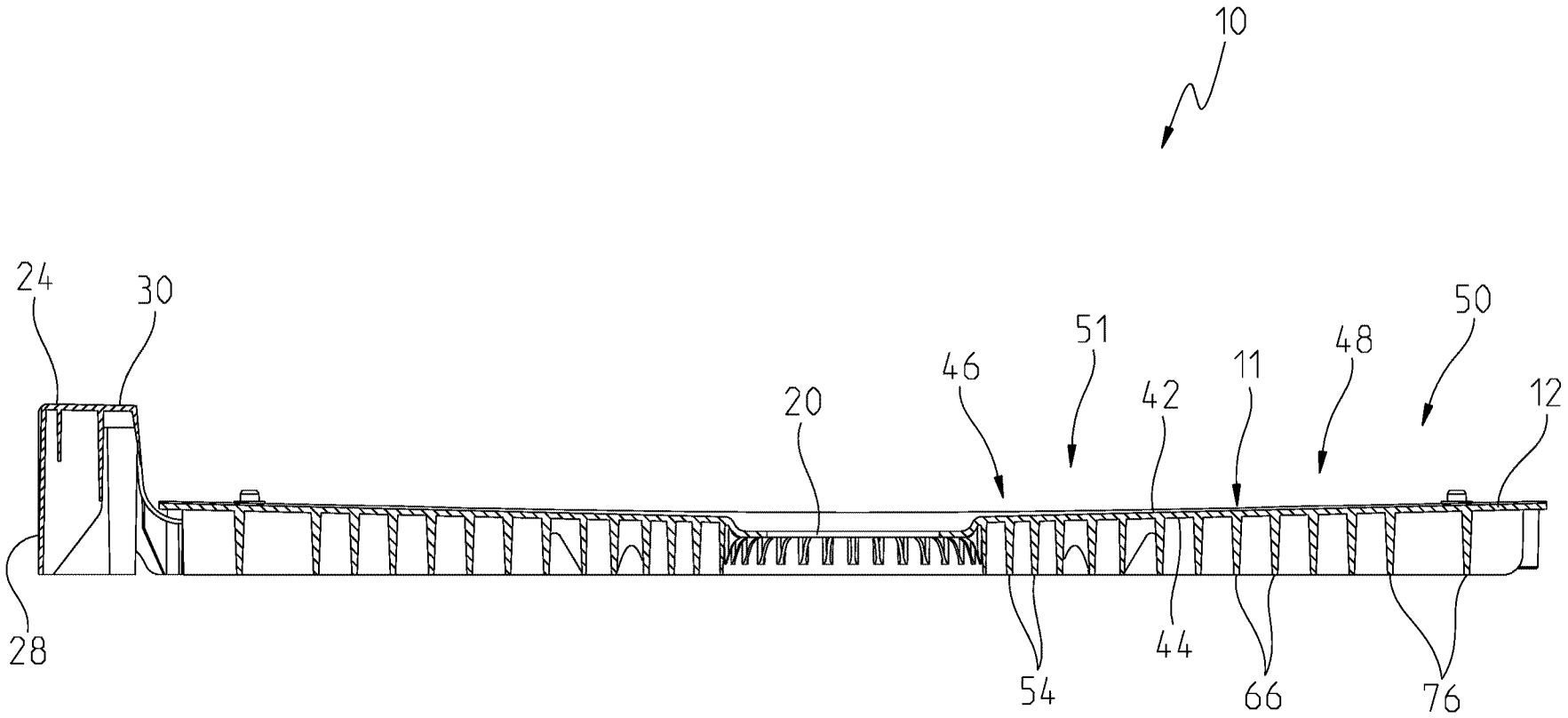
FIG. 8 is a transverse cross-sectional view of the shower pan of FIG. 1 taken along line 8-8.
Figure 21:
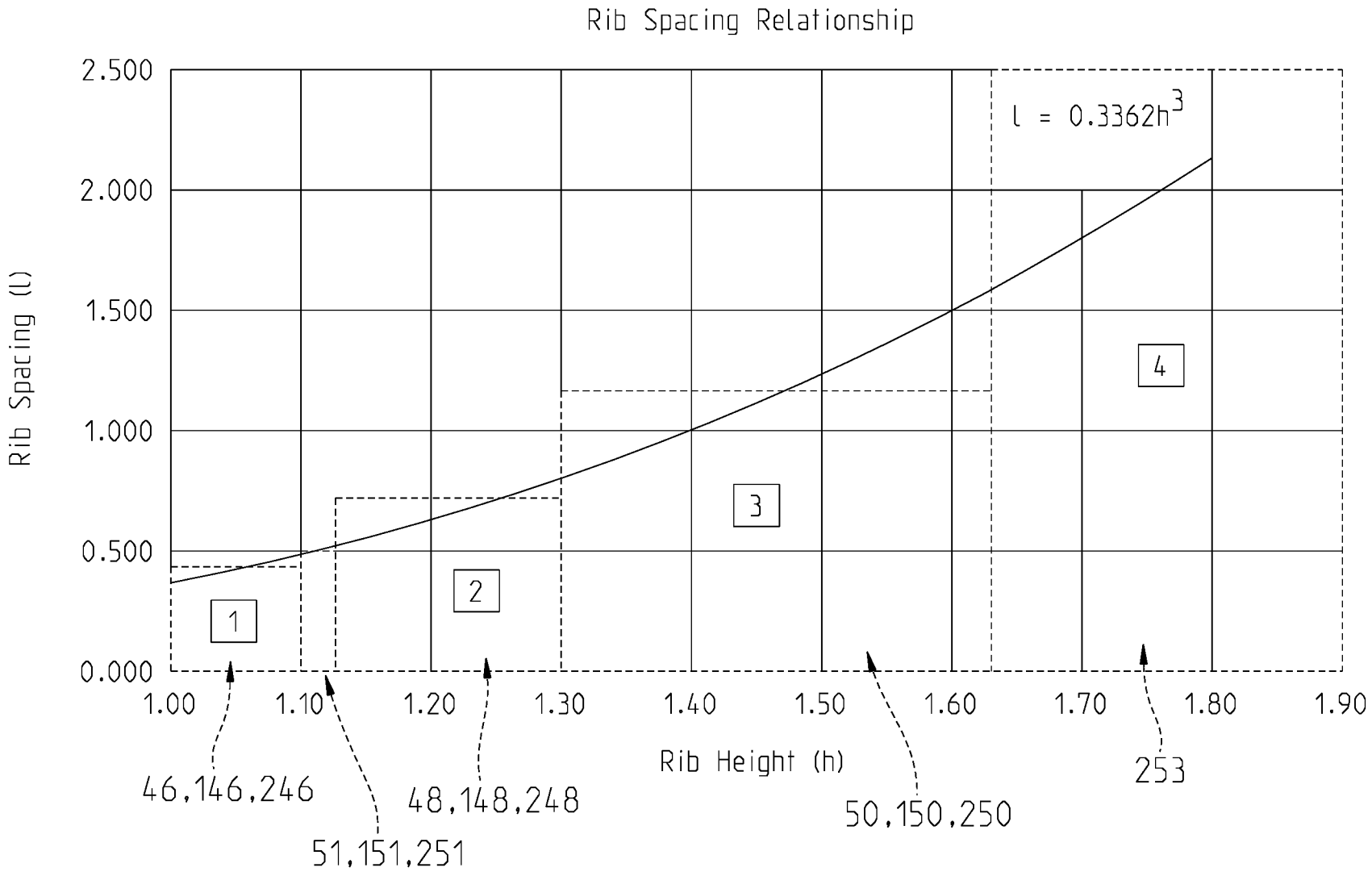
FIG. 21 is a graph showing an illustrative relationship between rib spacing and rib height.

With reference to FIGS. 4, 5 and 7, the first region 46 illustratively includes a plurality of first grids or cells 52 defined by a plurality of spaced-apart annular ribs 54, and a plurality of spaced apart radial ribs 56 intersecting the annular ribs 54. Adjacent annular ribs 54 are radially spaced apart by a first distance ($l_1$), while adjacent radial ribs 56 are spaced apart by approximately the same first distance ($l_1$). The ribs 54 and 56 illustratively have a thickness ($t_1$), and a height ($h_1$). Illustratively, the thickness ($t_1$) is approximately 0.075 inches. With reference to FIG. 21, in the illustrative embodiment, the average rib spacing ($l_1$) is a function of average rib height ($h_1$).

More particularly, adjacent rib spacing (l) is substantially equal to the product of the cube of rib height (h) and a reference constant (C), as substantially determined by the equation $l=C\ h^3$. Illustratively, the reference constant C is defined by a reference uniform rib structure as:

$$\frac{l_u}{h_u^3}$$

where $l_u$ is adjacent rib spacing of a reference uniform rib structure (e.g., 1.5 inches), and $h_u$ is rib height of a reference uniform rib structure (e.g., 1.6 inches). As such, the reference constant C is illustratively defined as being approximately 0.3662. The reference uniform rib structure is derived from a shower pan structure that is known to provide desired characteristics (e.g., structural rigidity). As such, the full symbolic formula is:

$$l = \frac{l_u}{h_u^3} h^3$$

In the illustrative embodiment of FIGS. 4 and 7, the average rib height ($h_1$) is approximately 1.1 inches defining an average adjacent rib spacing ($l_1$) of approximately 0.49 inches, given the reference constant C of 0.3662.

With reference to FIGS. 4, 5 and 7, the second region 48 illustratively includes a plurality of second grids or cells 62 defined by a plurality of spaced-apart longitudinal ribs 64 and a plurality of spaced-apart lateral ribs 66 extending transverse to, and intersecting, the longitudinal ribs 64. Adjacent lateral ribs 66 are longitudinally spaced apart by a second distance ($l_2$), while adjacent longitudinal ribs 64 are spaced apart by approximately the same second distance ($l_2$). The ribs 64 and 66 illustratively have a thickness ($t_2$), and a height ($h_2$). Illustratively, the thickness ($t_2$) is approximately 0.075 inches. With reference to FIG. 21, in the illustrative embodiment, the average rib spacing ($l_2$) is a function of average rib height ($h_2$) as substantially determined by the equation $l=C\ h^3$, where C is defined as a reference constant of approximately 0.3662. In the illustrative embodiment of FIG. 4, the average rib height ($h_2$) is approximately 1.27 inches defining an average rib spacing ($l_2$) of approximately 0.75 inches.

Figure 6:
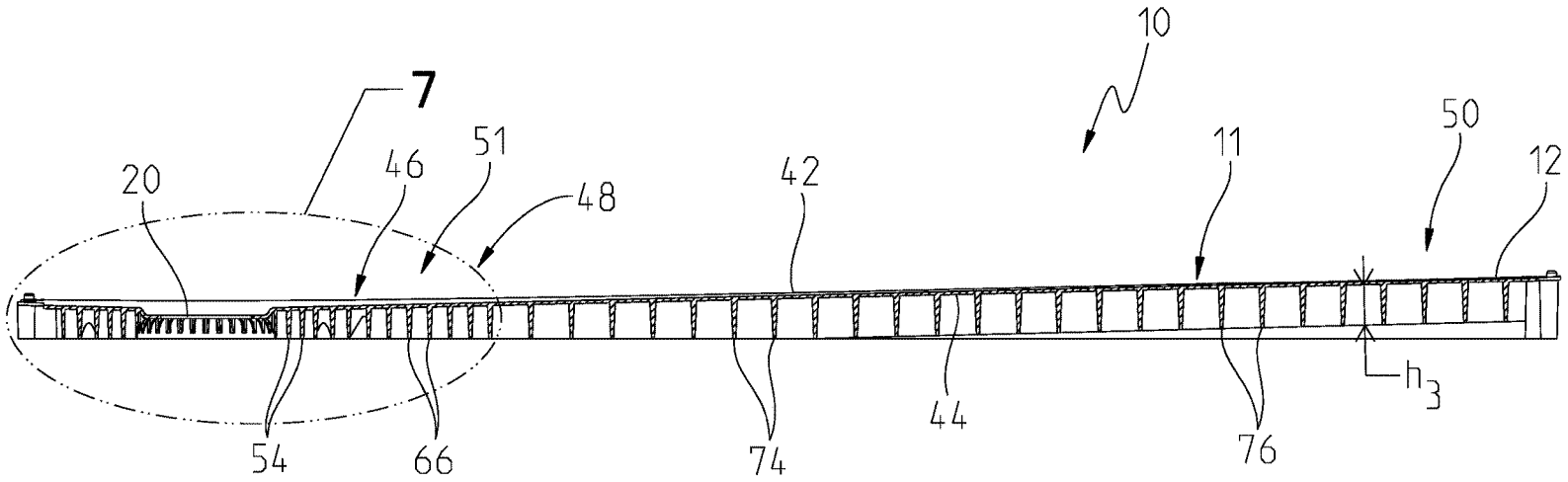
FIG. 6 is a longitudinal cross-sectional view of the shower pan of FIG. 1 taken along line 6-6.

With reference to FIGS. 4 and 6, the third region 50 illustratively includes a plurality of third grids or cells 72 defined by a plurality of spaced-apart longitudinal ribs 74 and a plurality of spaced-apart lateral ribs 76 extending transverse to, and intersecting, the longitudinal ribs 74. Adjacent lateral ribs 76 are longitudinally spaced apart by a third distance ($l_3$), while adjacent longitudinal ribs 64 are spaced apart by approximately the same second distance ($l_3$). The ribs 74 and 76 illustratively have a thickness ($t_3$), and a height ($h_3$). Illustratively, the thickness ($t_3$) is approximately 0.075 inches. With reference to FIG. 21, in the illustrative embodiment, the average rib spacing ($l_3$) is a function of average rib height ($h_3$) as substantially determined by the equation $l=C\ h^3$, where C is defined as a reference constant of approximately 0.3662. In the illustrative embodiment of FIG. 4, the average rib height ($h_3$) is approximately 1.6 inches defining an average rib spacing ($l_3$) of approximately 1.5 inches.

As shown in FIGS. 4 and 5, the plurality of first cells 52 are arranged in a plurality of rings 80 positioned concentrically around the drain opening 20. Each cell 52 includes linear side walls 82 and 84 defined by adjacent radial ribs 56, and arcuate side walls 86 and 88 defined by adjacent annular ribs 64. The plurality of second cells 62 include linear side walls 90 and 92 defined by adjacent longitudinal ribs 64, and linear side walls 94 and 96 defined by adjacent lateral ribs 66. Similarly, the plurality of third cells 72 include linear side walls 100 and 102 defined by adjacent longitudinal ribs 74, and linear side walls 104 and 106 defined by adjacent lateral ribs 76. Illustratively, the first and second cells 62 and 72 are polygons, such as rectangles and more particularly squares. In other words, the first cells 62 of the first region 46 are concentrically positioned relative to the drain opening 20, the second cells 72 of the second region 48 are polygons (illustratively rectangles, and more particularly squares) arranged in a rectilinear pattern, and the plurality of third cells 72 of the third region 50 are polygons (illustratively rectangles, and more particularly squares) arranged in a rectilinear pattern.

With reference again to FIGS. 2, 4 and 5, the transition region 51 provides for a bridge or transition between the first region 46 and the second region 48. More particularly, the transition region 51 illustratively includes a plurality of ribs 108 defining a plurality of grids or cells 109 that transition between the concentric annular cells 52 of the first region 46 and the rectangular cells 62 of the second region 48.

Illustratively, the base 12 and the ribs 54, 56, 64, 66, 74, 76 and 108 of the shower pan 10 are integrally molded from a polymer. For example, the body 11 of the shower pan 10 may be formed from an injection molded glass-filled polypropylene. Alternatively, the shower pan 10 may be formed from other suitable materials, such as an acrylonitrile butadiene styrene, an acrylic capped high impact polystyrene, a crystal capped high impact polystyrene, a sheet molded compound material or a fiberglass reinforced plastic.

Figure 10:
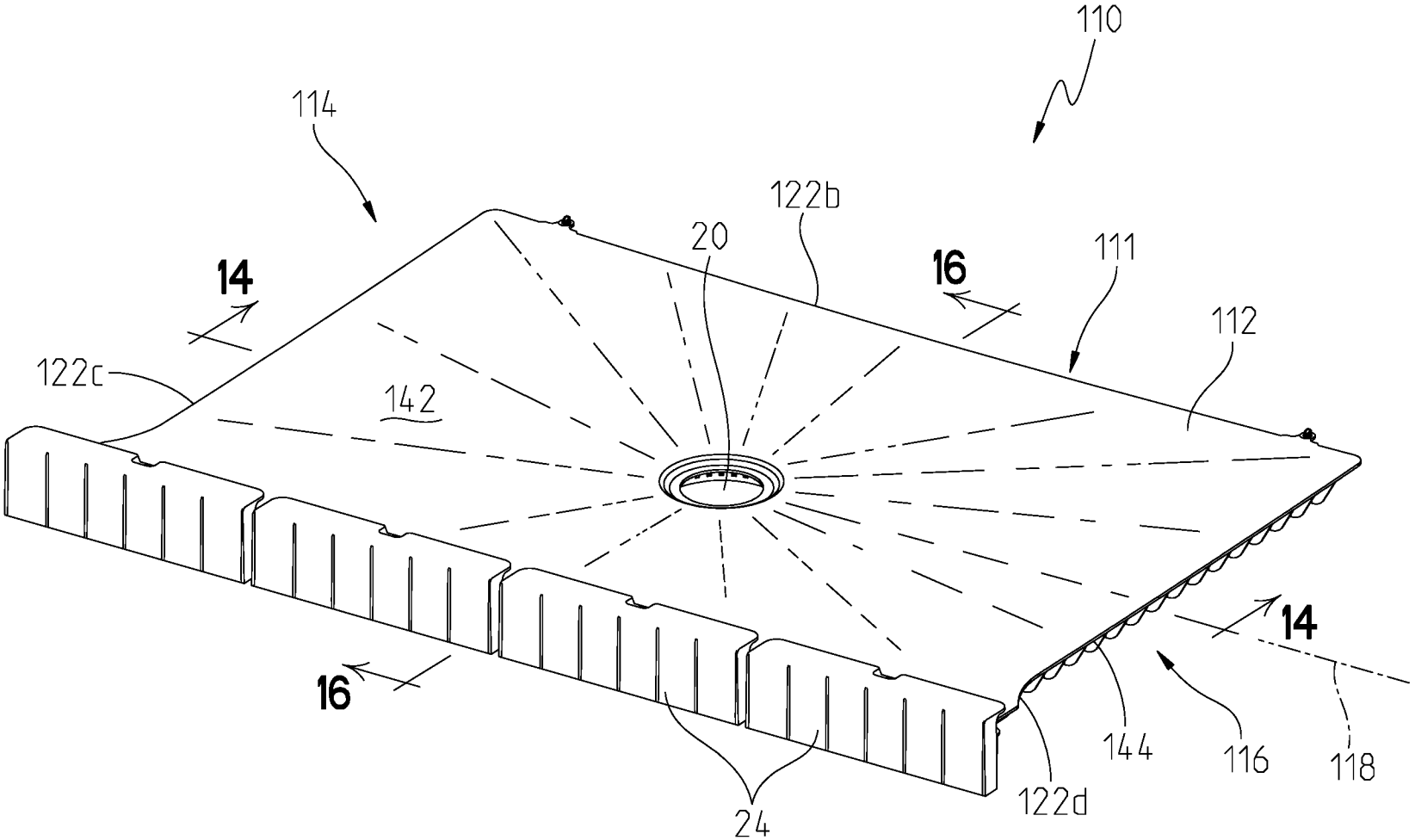
FIG. 10 is a top perspective view of a further illustrative shower pan of the present disclosure, showing a drain opening positioned near a center and threshold forms positioned at a front edge.
Figure 11:
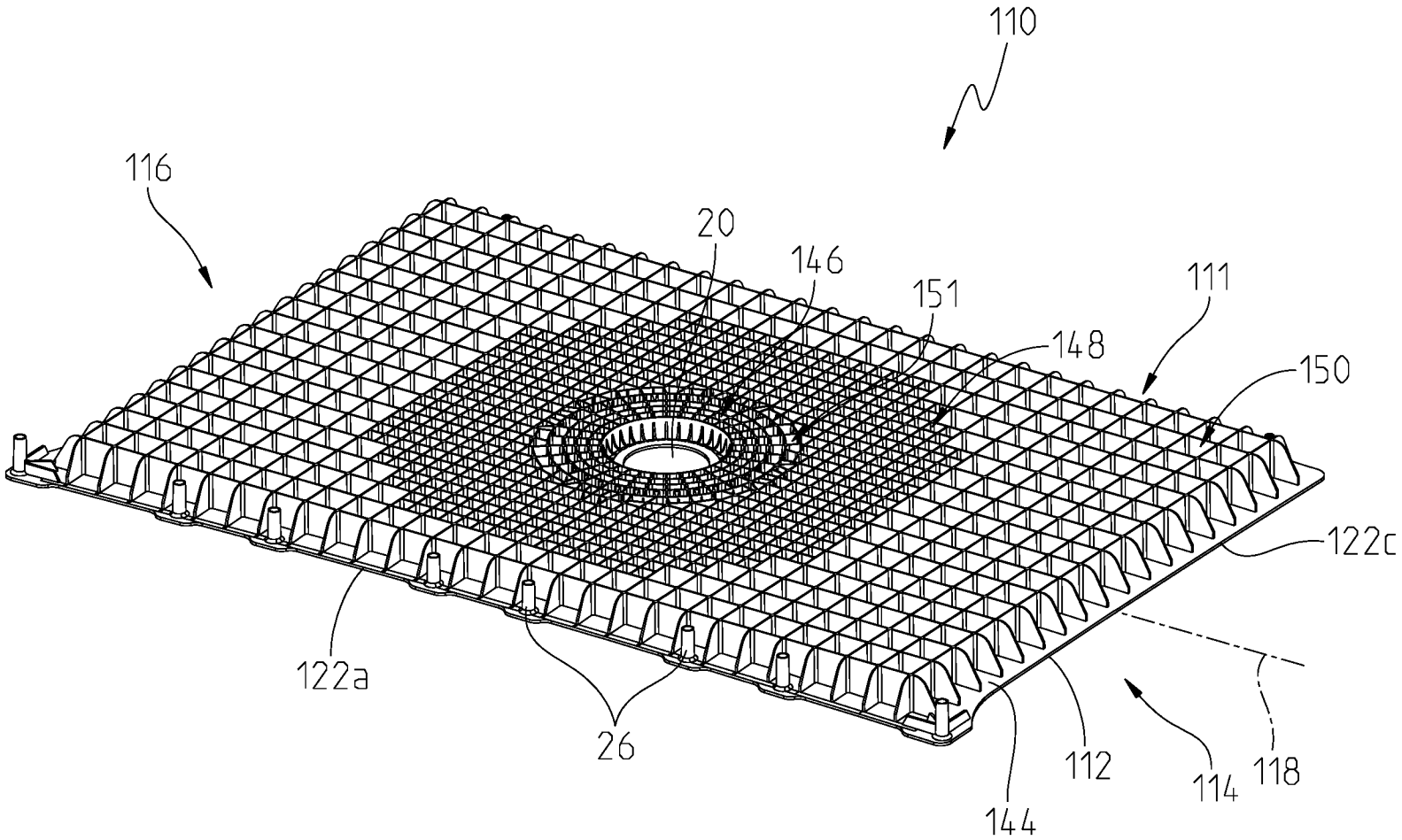
FIG. 11 is a bottom perspective view of the shower pan of FIG. 10.
Figure 12:
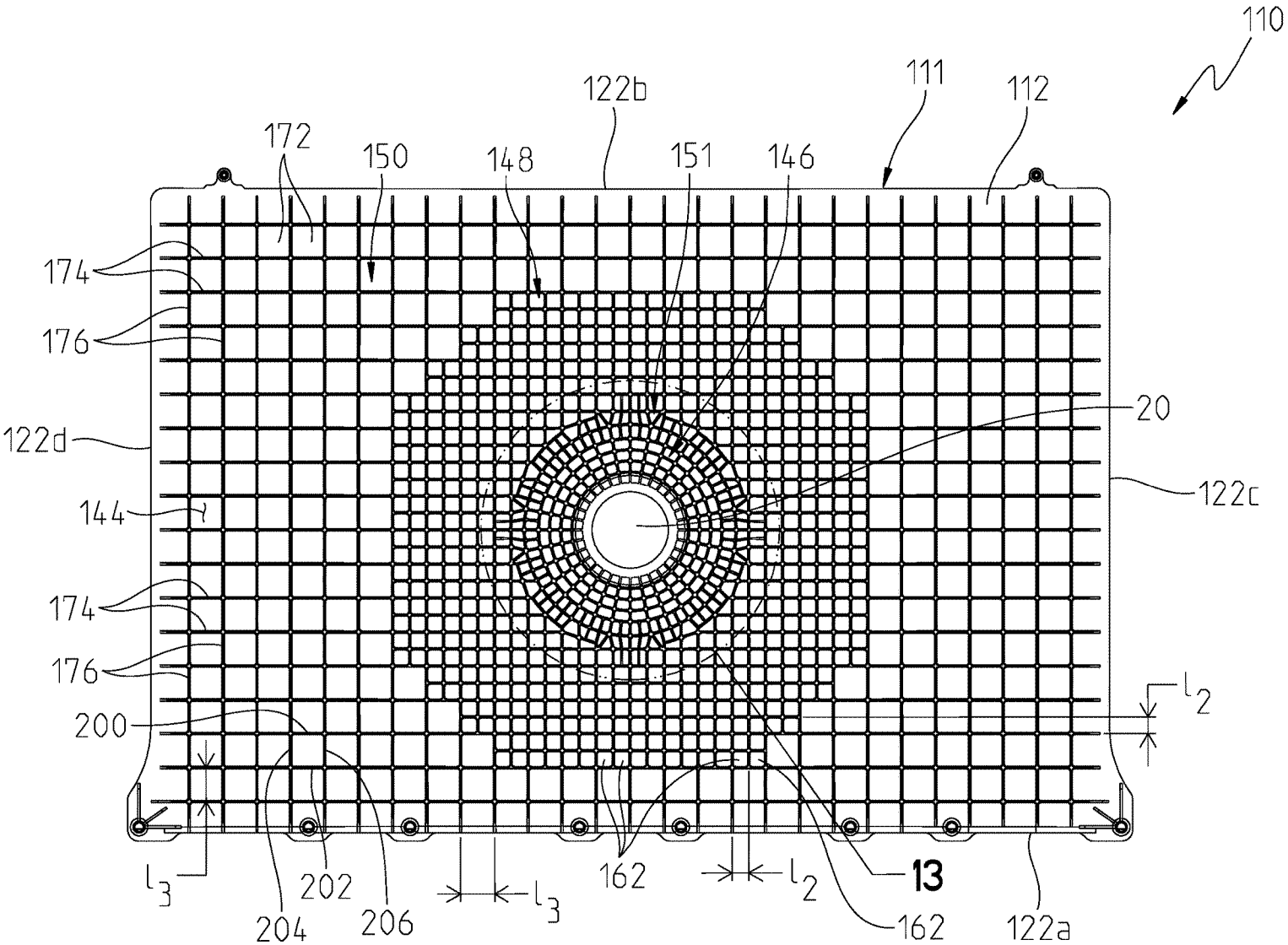
FIG. 12 is a bottom plan view of the shower pan of FIG. 10.

With reference now to FIGS. 10-12, a further illustrative shower floor or pan 110 is shown as including many similar elements as the shower pan 10 of FIGS. 1-9. As such, in the following description, similar components are identified with like reference numbers.

The illustrative shower pan 110 includes a body 111 having a base or support wall 112 extending between a proximal end 114 and a distal end 116 along a longitudinal axis 118. A drain opening 20 is formed within the base 112 and is illustratively positioned along the longitudinal axis 118 near the center of the base 112. The base 112 includes a plurality of peripheral edges 122. In the illustrative embodiment, the peripheral edges 122*a*, 122*b*, 122*c*, 122*d* are linear to define the rectangular base 112. It should be appreciated that the shapes and dimensions of the peripheral edges 122*a*, 122*b*, 122*c*, 122*d* may vary based upon, for example, the size and shape of the base 112 and the location of the drain opening 20.

The base 112 illustratively includes a substantially planar upper surface 142 and a lower surface 144 defining a plurality of regions 146, 148, 150 and 151 defining a grid or cell structure. More particularly, the shower pan 110 illustratively includes a first zone or region 146 with the drain opening 20 extending between the upper surface 142 and the lower surface 144. A second zone or region 148 is illustratively contiguous to, and radially distal of, the first region 146. Similarly, a third zone or region 150 is illustratively contiguous to, and radially distal of, the second region 148. Illustratively, a transition zone or region 151 may extend between the first region 146 and the second region 148. The number, size and positioning of the regions 146, 148, 150, 151 may vary based upon, for example, the size and shape of the base 112 and the location of the drain opening 20.

Figure 13:
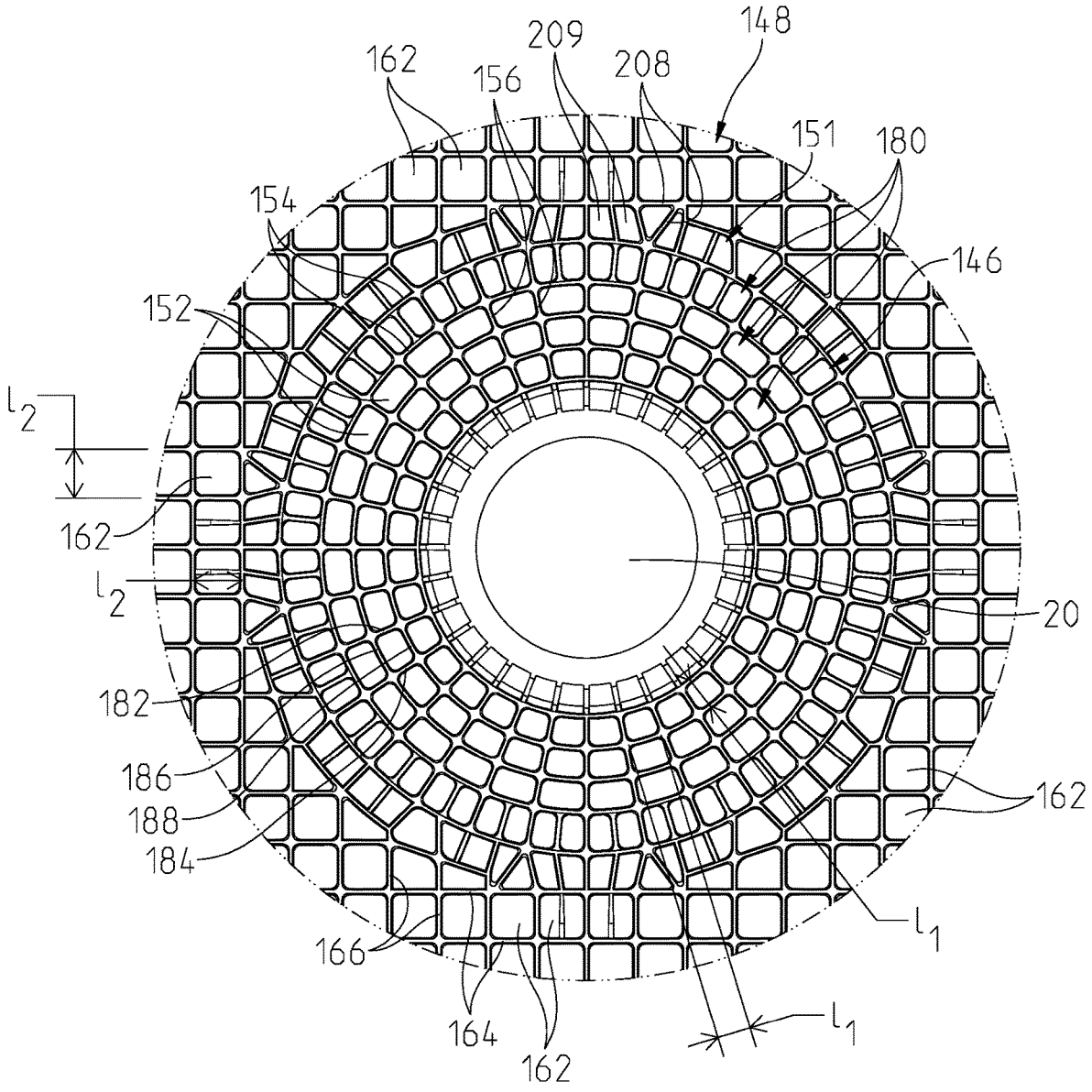
FIG. 13 is a detail view of FIG. 12.
Figure 15:
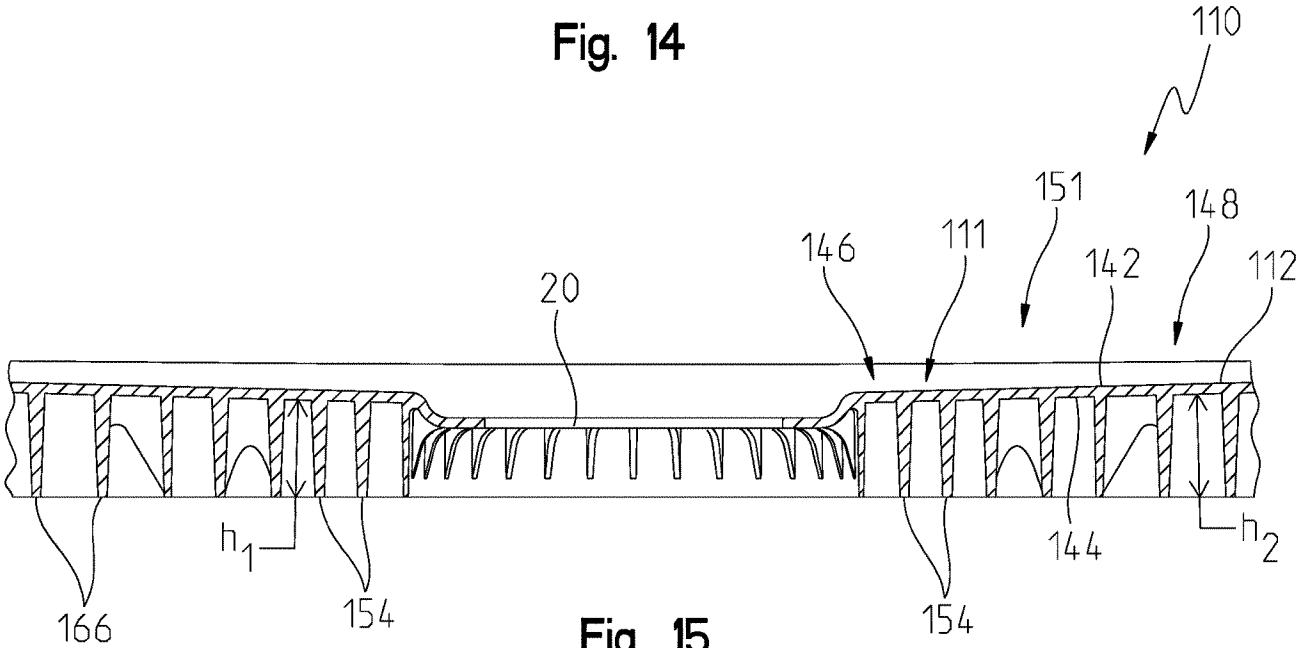
FIG. 15 is a detail view of FIG. 14.

With reference to FIGS. 12, 13 and 15, the first region 146 illustratively includes a plurality of first grids or cells 152 defined by a plurality of spaced-apart annular ribs 154, and a plurality of spaced apart radial ribs 156 intersecting the annular ribs 154. Adjacent annular ribs 154 are radially spaced apart by a first distance ($l_1$), while adjacent radial ribs 156 are spaced apart by approximately the same first distance ($l_1$). The ribs 154 and 156 illustratively have a thickness ($t_1$), and a height ($h_1$). Illustratively, the thickness ($t_1$) is approximately 0.075 inches. With reference to FIG. 21 and as further detailed above, in the illustrative embodiment, the average rib spacing ($l_1$) is a function of average rib height ($h_1$) as substantially determined by the equation $l=C\ h^3$, where C is defined as a reference constant of approximately 0.3662. In the illustrative embodiment of FIGS. 13 and 15, the average rib height ($h_1$) is approximately 1.1 inches defining an average rib spacing ($l_1$) of approximately 0.49 inches.

With referent to FIGS. 12, 13 and 15, the second region 148 illustratively includes a plurality of second grids or cells 162 defined by a plurality of spaced-apart longitudinal ribs 164 and a plurality of spaced-apart lateral ribs 166 extending transverse to, and intersecting, the longitudinal ribs 164. Adjacent lateral ribs 166 are longitudinally spaced apart by a second distance ($l_2$), while adjacent longitudinal ribs 164 are spaced apart by approximately the same second distance ($l_2$). The ribs 164 and 166 illustratively have a thickness ($t_2$), and a height ($h_2$). Illustratively, the thickness ($t_2$) is approximately 0.075 inches. With reference to FIG. 21, in the illustrative embodiment, the average rib spacing ($l_2$) is a function of average rib height ($h_2$) as substantially determined by the equation $l=C\ h^3$, where C is defined as a reference constant of approximately 0.3662. In the illustrative embodiment of FIG. 15, the average rib height ($h_2$) is approximately 1.27 inches defining an average rib spacing ($l_2$) of approximately 0.75 inches.

Figure 14:
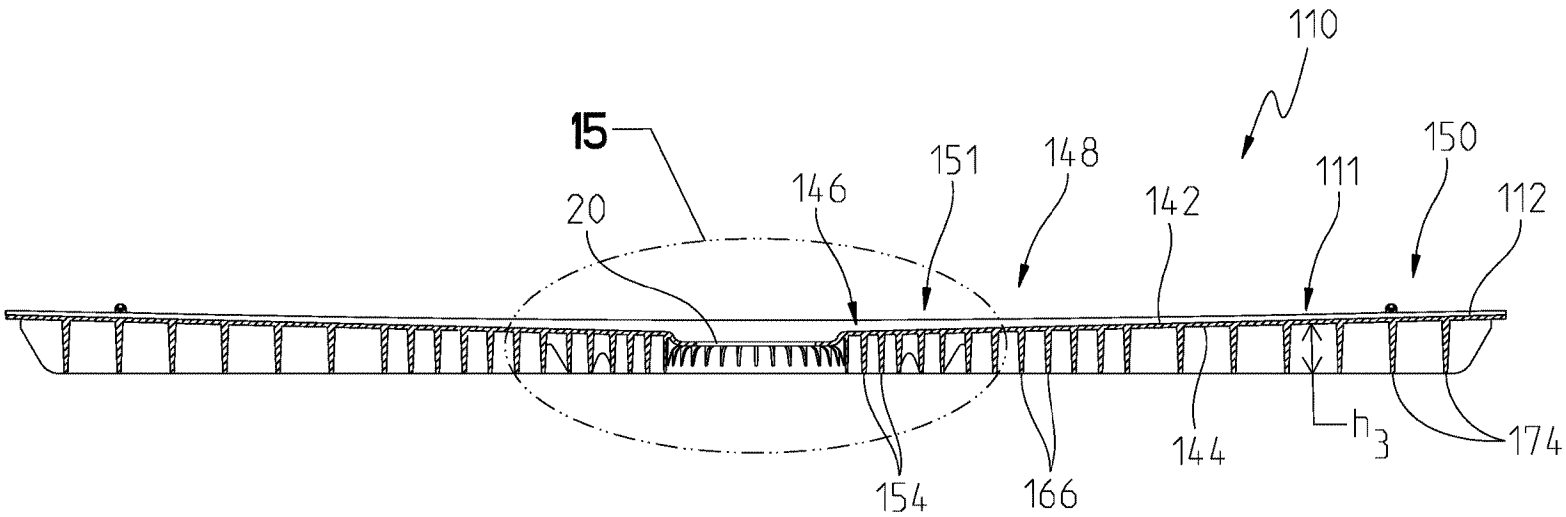
FIG. 14 is a longitudinal cross-sectional view of the shower pan of FIG. 10 taken along line 14-14.
Figure 16:
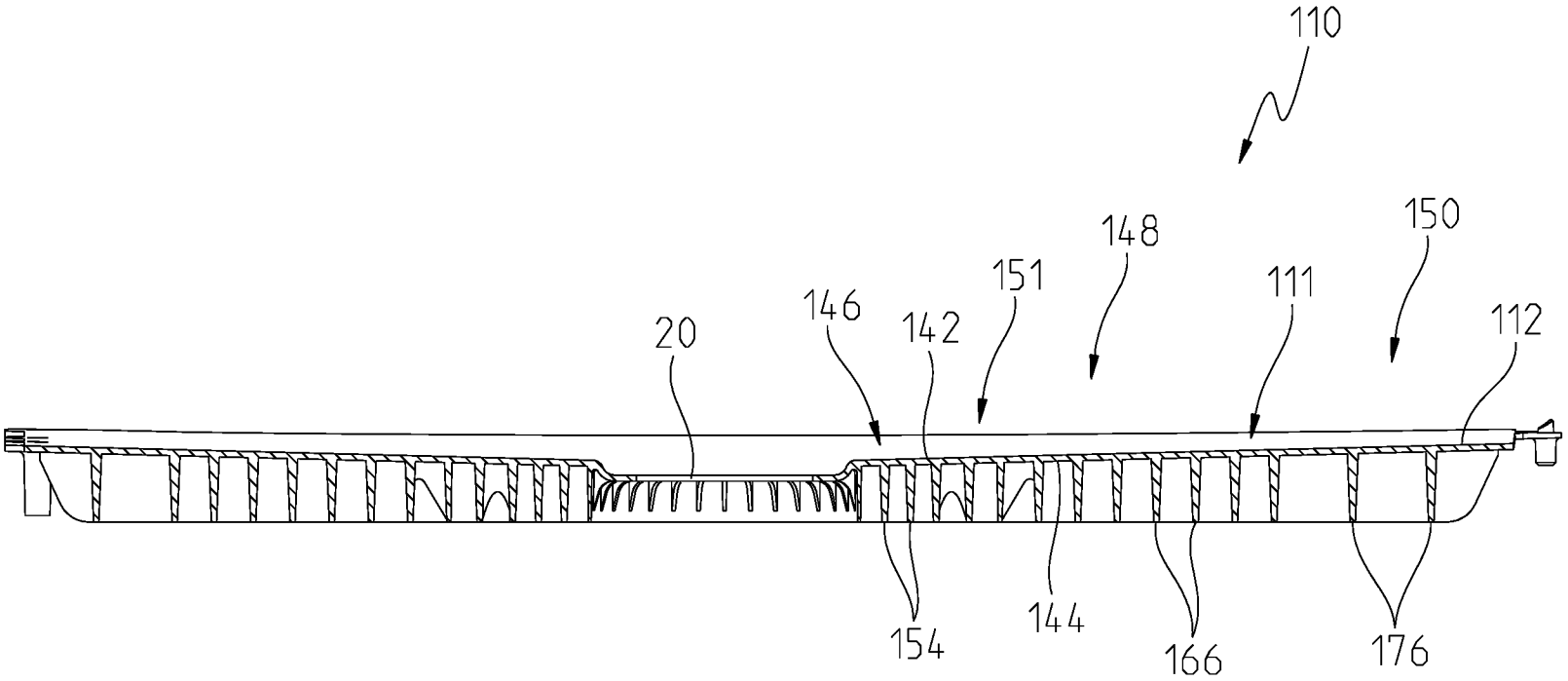
FIG. 16 is a transverse cross-sectional view of the shower pan of FIG. 10 taken along line 16-16.

With reference to FIGS. 12, 14 and 16, the third region 150 illustratively includes a plurality of third grids or cells 172 defined by a plurality of spaced-apart longitudinal ribs 174 and a plurality of spaced-apart lateral ribs 176 extending transverse to, and intersecting, the longitudinal ribs 174. Adjacent lateral ribs 176 are longitudinally spaced apart by a third distance ($l_3$), while adjacent longitudinal ribs 174 are spaced apart by approximately the same third distance ($l_3$). The ribs 174 and 176 illustratively have a thickness ($t_3$), and a height ($h_3$). Illustratively, the thickness ($t_3$) is approximately 0.075 inches. With reference to FIG. 21, in the illustrative embodiment, the average rib spacing ($l_3$) is a function of average rib height ($h_3$) as substantially determined by the equation $l=C\ h^3$, where C is defined as a reference constant of approximately 0.3662. In the illustrative embodiment of FIG. 15, the average rib height ($h_3$) is approximately 1.6 inches defining an average rib spacing ($l_3$) of approximately 1.5 inches.

As shown in FIGS. 12 and 13, the plurality of first cells 152 are arranged in a plurality of rings 180 positioned concentrically around the drain opening 20. Each cell 152 includes linear side walls 182 and 184 defined by adjacent radial ribs 156, and arcuate side walls 176 and 178 defined by adjacent annular ribs 154. The plurality of second cells 162 include linear side walls 190 and 182 defined by adjacent longitudinal ribs 154, and linear side walls 194 and 196 defined by adjacent lateral ribs 156. Similarly, the plurality of third cells 172 include linear side walls 200 and 202 defined by adjacent longitudinal ribs 174, and linear side walls 204 and 206 defined by adjacent lateral ribs 176. Illustratively, the first and second cells 152 and 162 are polygons, such as rectangles and more particularly squares. In other words, the first cells 152 of the first region 146 are concentrically positioned relative to the drain opening 20, the second cells 162 of the second region 148 are polygons (illustratively rectangles, and more particularly squares) arranged in a rectilinear pattern, and the plurality of third cells 172 of the third region 150 are polygons (illustratively rectangles, and more particularly squares) arranged in a rectilinear pattern.

With reference again to FIGS. 11-13, the transition region 151 provides for a bridge or transition between the first region 146 and the second region 148. More particularly, the transition region 151 illustratively includes a plurality of ribs 208 defining a plurality of cells 209 that transition between the concentric annular cells 152 of the first region 146 and the rectangular cells 162 of the second region 148.

Illustratively, the base 112 and ribs 154, 156, 164, 166, 174, 176 and 208 of the shower pan 110 are molded from a polymer. For example, the body 111 of the shower pan 110 may be formed from an injection molded glass-filled polypropylene. Alternatively, the shower pan 110 may be formed from other suitable materials, such as an acrylonitrile butadiene styrene, an acrylic capped high impact polystyrene, a crystal capped high impact polystyrene, a sheet molded compound material or a fiberglass reinforced plastic.

With reference now to FIGS. 17-20, a further illustrative shower floor or pan 210 is shown as including many similar elements as the shower pans 10 and 110 of FIGS. 1-9 and 10-16, respectively. As such, in the following description, similar components are identified with like reference numbers.

The illustrative shower pan 210 includes a body 211 having a base or support wall 212 extending between a proximal end 214 and a distal end 216 along a longitudinal axis 218. A drain opening 20 is formed within the base 212 and is illustratively positioned along the longitudinal axis 218 near the proximal end 214 of the base 212. The base 212 includes a plurality of peripheral edges 222. In the illustrative embodiment, the front edge 222*a* is arcuate, while edges 222*b* and 222*c* are linear and intersect at a rear corner 223. As such, the illustrative shower pan 210 is configured for corner mounting. It should be appreciated that the shapes and dimensions of the peripheral edges 222*a*, 222*b*, 222*c* may vary based upon, for example, the size and shape of the base 212 and the location of the drain opening 20.

Figure 17:
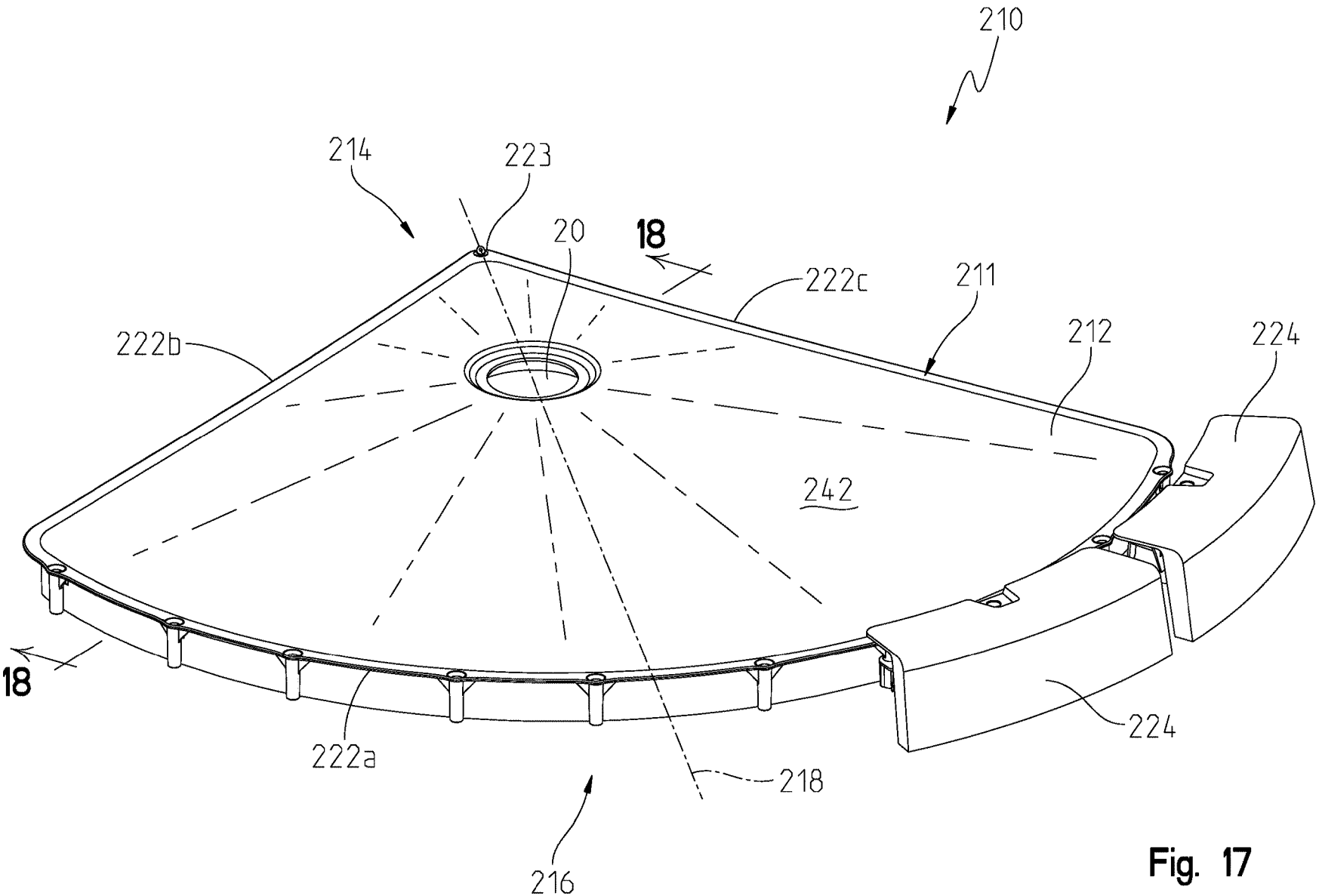
FIG. 17 is a top perspective view of a further illustrative shower pan of the present disclosure.

With reference to FIG. 17, a plurality of threshold forms 224 are illustratively supported by the front edge 222*a* of the base 212. As may be appreciated, the threshold forms 224 define an entry barrier for the shower pan 10 and may be of similar design as the threshold forms 24 detailed above. However, the threshold forms 224 are arcuate in shape to conform to the curved front edge 222*a*.

Figure 18:
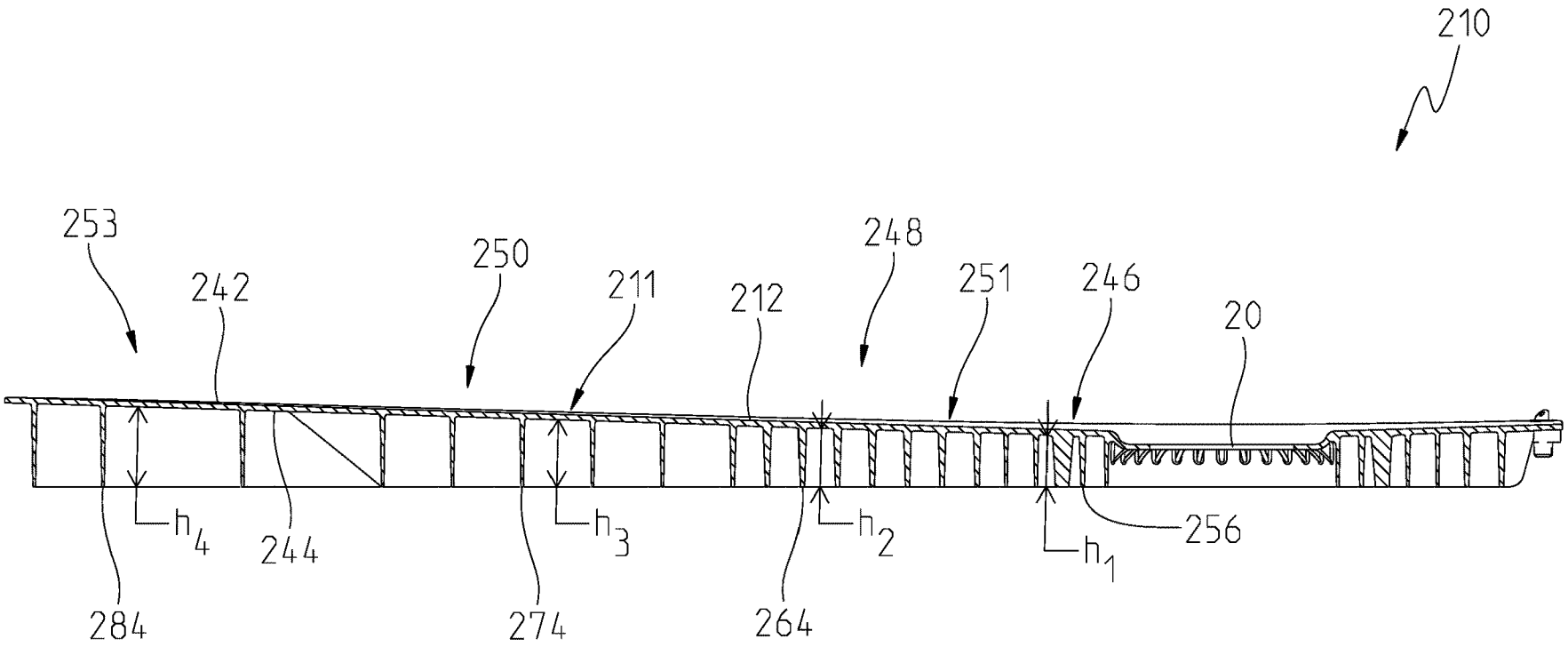
FIG. 18 is a cross-sectional view of the shower pan of FIG. 17 taken along line 18-18.
Figure 19:
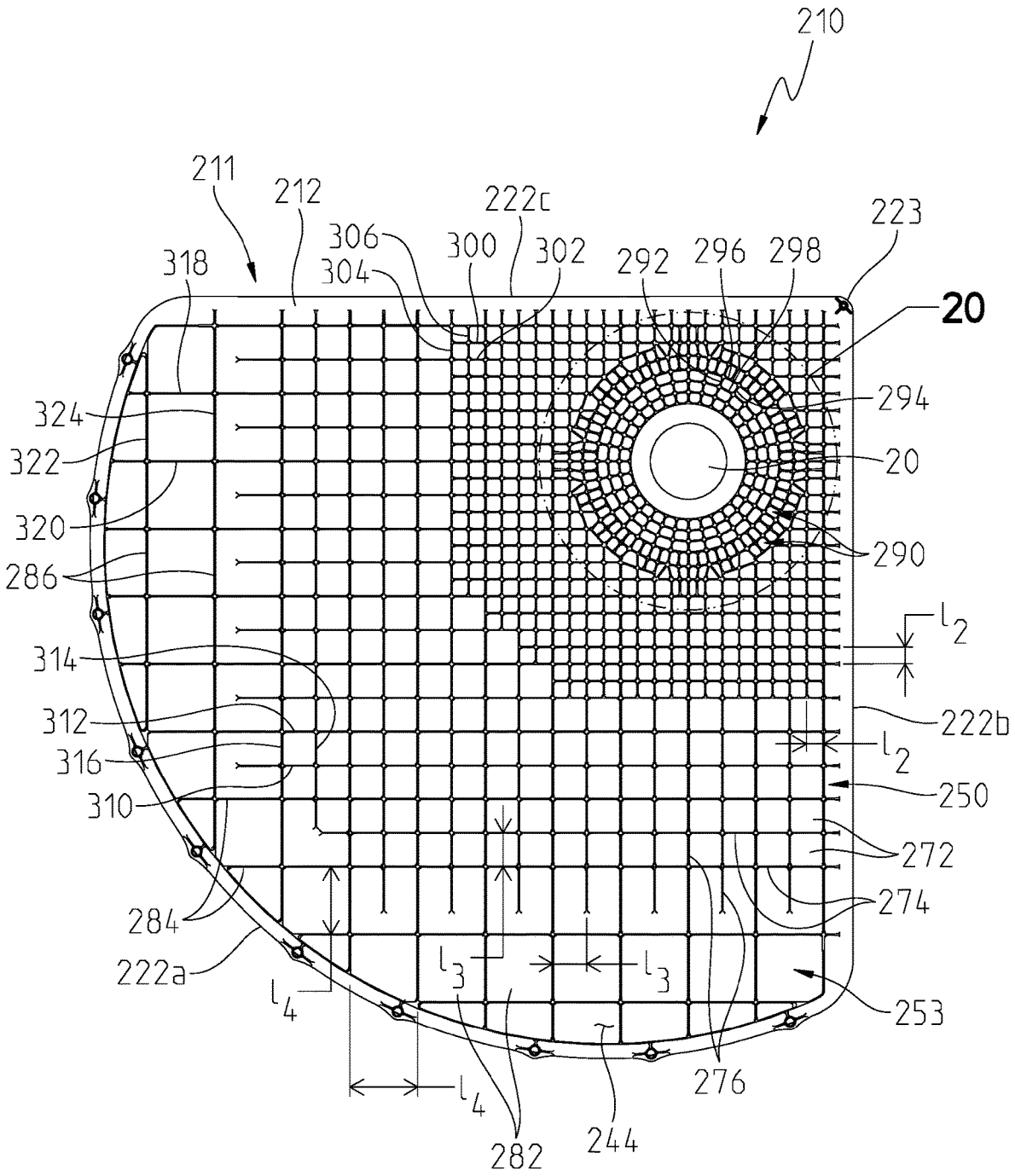
FIG. 19 is a bottom plan view of the shower pan of FIG. 17.
Figure 20:
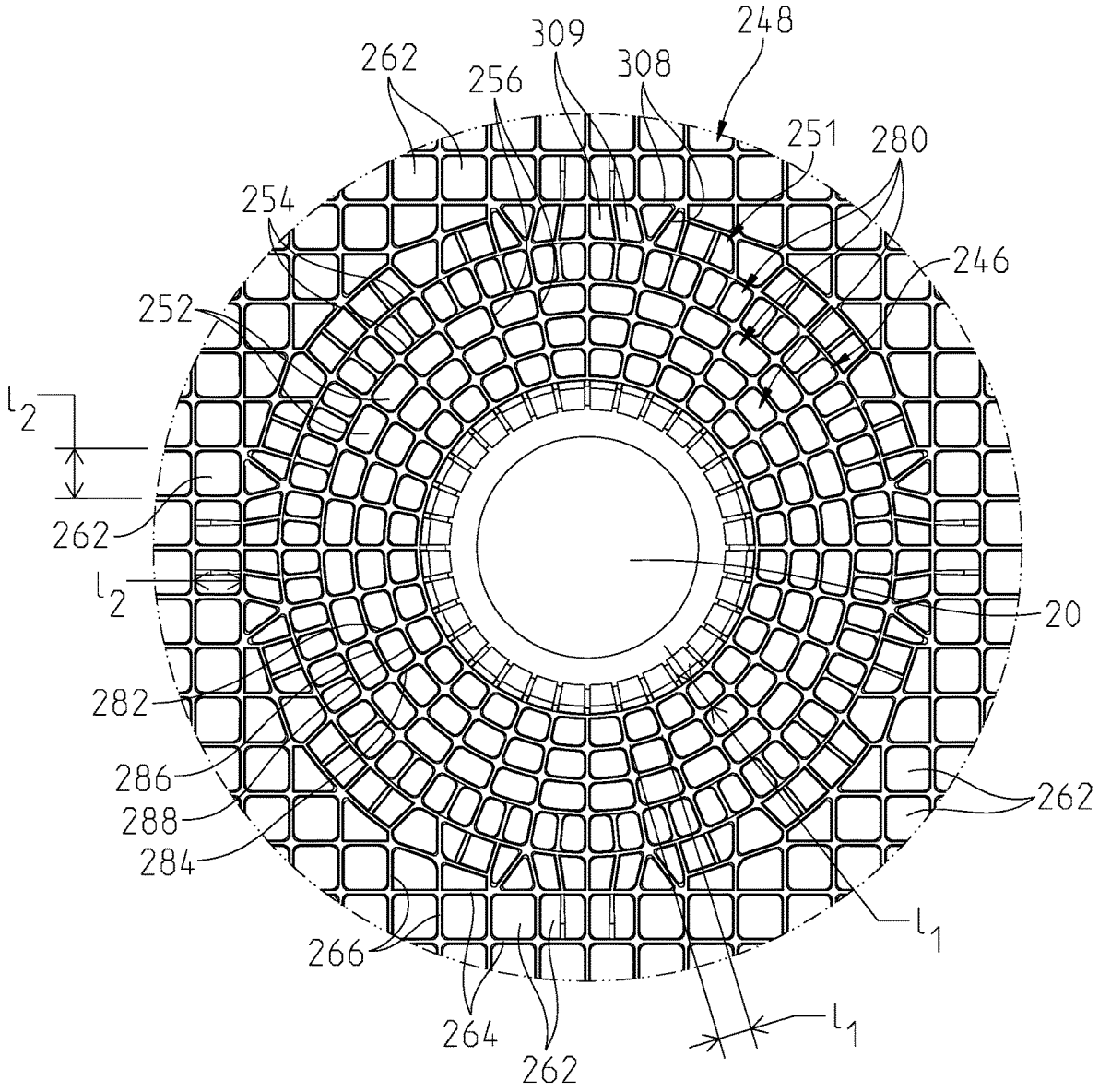
FIG. 20 is a detail view of FIG. 19.

With reference to FIGS. 18-20, the base 212 illustratively includes a substantially planar upper surface 242 and a lower surface 244 defining a plurality of regions 246, 248, 250, 251 and 253 defining a grid or cell structure. More particularly, the shower pan 210 illustratively includes a first zone or region 246 with the drain opening 20 extending between the upper surface 242 and the lower surface 244. A second zone or region 248 is illustratively contiguous to, and distal of, the first region 246. Similarly, a third zone or region 250 is illustratively contiguous to, and distal of, the second region 248. A fourth zone or region 253 is illustratively contiguous to, and distal of, the third region 250. Illustratively, a transition zone or region 251 may extend between the first region 246 and the second region 248. The number, size and positioning of the regions 246, 248, 250, 251, 253 may vary based upon, for example, the size and shape of the base 212 and the location of the drain opening 20.

Similar to the shower pan 10 as shown in FIGS. 4 and 5, the first region 246 illustratively includes a plurality of first grids or cells 252 defined by a plurality of spaced-apart annular ribs 254, and a plurality of spaced apart radial ribs 256 intersecting the annular ribs 254. Adjacent annular ribs 254 are radially spaced apart by a first distance ($l_1$), while adjacent radial ribs 256 are spaced apart by approximately the same first distance ($l_1$). The ribs 254 and 256 illustratively have a thickness ($t_1$), and a height ($h_1$). Illustratively, the thickness ($t_1$) is approximately 0.075 inches. With reference to FIG. 21 and as further detailed above, in the illustrative embodiment, the average rib spacing ($l_1$) is a function of average rib height ($h_1$) as substantially determined by the equation $l=C\ h^3$, where C is defined as a reference constant of approximately 0.3662. In the illustrative embodiment of FIGS. 18-20, the average rib height ($h_1$) is approximately 1.1 inches defining an average rib spacing ($l_1$) of approximately 0.49 inches.

The second region 248 illustratively includes a plurality of second grids or cells 262 defined by a plurality of spaced-apart longitudinal ribs 264 and a plurality of spaced-apart lateral ribs 266 extending transverse to, and intersecting, the longitudinal ribs 264. Adjacent lateral ribs 266 are longitudinally spaced apart by a second distance ($l_2$), while adjacent longitudinal ribs 264 are spaced apart by approximately the same second distance ($l_2$). The ribs 264 and 266 illustratively have a thickness ($t_2$), and a height ($h_2$). Illustratively, the thickness ($t_2$) is approximately 0.075 inches. With reference to FIG. 21, in the illustrative embodiment, the average rib spacing ($l_2$) is a function of average rib height ($h_2$) as substantially determined by the equation $l=C\ h^3$, where C is defined as a reference constant of approximately 0.3662. In the illustrative embodiment of FIGS. 18-20, the average rib height ($h_2$) is approximately 1.27 inches defining an average rib spacing ($l_2$) of approximately 0.75 inches.

The third region 250 illustratively includes a plurality of third grids or cells 272 defined by a plurality of spaced-apart longitudinal ribs 274 and a plurality of spaced-apart lateral ribs 276 extending transverse to, and intersecting, the longitudinal ribs 274. Adjacent lateral ribs 276 are longitudinally spaced apart by a third distance ($l_3$), while adjacent longitudinal ribs 274 are spaced apart by approximately the same third distance ($l_3$). The ribs 274 and 276 illustratively have a thickness ($t_3$), and a height ($h_3$). Illustratively, the thickness ($t_3$) is approximately 0.075 inches. With reference to FIG. 21, in the illustrative embodiment, the average rib spacing ($l_3$) is a function of average rib height ($h_3$) as substantially determined by the equation $l=C\ h^3$, where C is defined as a reference constant of approximately 0.3662. In the illustrative embodiment of FIGS. 18 and 19, the average rib height ($h_3$) is approximately 1.6 inches defining an average rib spacing ($l_3$) of approximately 1.5 inches.

The fourth region 253 illustratively includes a plurality of fourth grids or cells 282 defined by a plurality of spaced-apart longitudinal ribs 284 and a plurality of spaced-apart lateral ribs 286 extending transverse to, and intersecting, the longitudinal ribs 284. Adjacent lateral ribs 286 are longitudinally spaced apart by a fourth distance ($l_4$), while adjacent longitudinal ribs 284 are spaced apart by approximately the same fourth distance ($l_4$). The ribs 284 and 286 illustratively have a thickness ($t_4$), and a height ($h_4$). Illustratively, the thickness ($t_4$) is approximately 0.075 inches. With reference to FIG. 21, in the illustrative embodiment, the average rib spacing ($l_4$) is a function of average rib height ($h_4$) as substantially determined by the equation $l=C\ h^3$, where C is defined as a reference constant of approximately 0.3662. In the illustrative embodiment of FIGS. 18 and 19, the average rib height ($h_4$) is approximately 1.75 inches defining an average rib spacing ($l_4$) of approximately 2.0 inches.

As shown in FIGS. 18-20, the plurality of first cells 252 are arranged in a plurality of rings 290 positioned concentrically around the drain opening 20. Each cell 252 includes linear side walls 292 and 294 defined by radial ribs 256, and arcuate side walls 296 and 298 defined by annular ribs 254. The plurality of second cells 262 include linear side walls 300 and 302 defined by longitudinal ribs 264, and linear side walls 304 and 306 defined by lateral ribs 266. Similarly, the plurality of third cells 272 include linear side walls 310 and 312 defined by longitudinal ribs 274, and linear side walls 314 and 316 defined by lateral ribs 276. The plurality of fourth cells 282 illustratively include linear side walls 318 and 320 defined by longitudinal ribs 284, and linear side walls 322 and 324 defined by lateral ribs 286.

Illustratively, the first and second cells 262 and 272 are polygons, such as rectangles and more particularly squares. In other words, the first cells 252 of the first region 248 are concentrically positioned relative to the drain opening 20, the second cells 262 of the second region 248 are polygons (illustratively rectangles, and more particularly squares) arranged in a rectilinear pattern, the plurality of third cells 272 of the third region 250 are polygons (illustratively rectangles, and more particularly squares) arranged in a rectilinear pattern, and the fourth cells 282 of the fourth region 253 are polygons (illustratively rectangles, and more particularly squares) arranged in a rectilinear pattern.

With reference again to FIGS. 18-20, the transition region 251 provides for a bridge or transition between the first region 246 and the second region 248. More particularly, the transition region 251 illustratively includes a plurality of ribs 318 defining a plurality of cells 319 that transition between the concentric annular cells 252 of the first region 246 and the rectangular cells 262 of the second region 248.

Illustratively, the base 212 and ribs 254, 256, 264, 266, 274, 276, 284, 286 and 318 of the shower pan 210 are integrally molded from a polymer. For example, the body 211 of the shower pan 210 may be formed from an injection molded glass-filled polypropylene. Alternatively, the shower pan 210 may be formed from other suitable materials, such as an acrylonitrile butadiene styrene, an acrylic capped high impact polystyrene, a crystal capped high impact polystyrene, a sheet molded compound material or a fiberglass reinforced plastic.

The illustrative shower pan of the present disclosure provides uniform resistance to bending when boundary geometry does not allow for uniform structure thickness. Variation in the structure thickness means that the height of the integral ribs will vary. An evenly spaced rib grid structure, with varying structure thickness will result in variation in the rigidity of the structure. Short ribs will bend more, while tall ribs will bend less under an equivalent load.

The strength and rigidity, specifically the area moment of inertia of integral ribs in a support structure greatly depends on the height of the rib. Geometry constraints require that the height of the structure gradually decreases towards the overall center. Rib spacing is decreased as rib height decreases so that the overall structure has an approximate uniform area moment of inertia relative to specific reference axes. Therefore, the rigidity of the overall structure is uniform. In addition, rib spacing is illustratively split into distinct zones, and the transition between zones, where specific ribs intersect is configured to reduce stress in the structure.

Although the invention has been described in detail with reference to certain preferred embodiments, variations and modifications exist within the spirit and scope of the invention as described and defined in the following claims.

The invention claimed is:

1. A shower pan comprising:

a body including:

a base defining a longitudinal axis;

a first region including a drain opening extending through the base, the longitudinal axis extending through a center of the drain opening, a plurality of cells defined by a plurality of spaced-apart annular ribs, and a plurality of spaced apart radial ribs intersecting the annular ribs, wherein adjacent ones of the annular ribs are radially spaced apart by a first distance, the radial spacing between adjacent ones of the annular ribs being a function of the height of the annular ribs;

a second region contiguous to, and distal of, the first region, the second region including a plurality of second cells defined by a plurality of spaced-apart longitudinal ribs and a plurality of spaced-apart lateral ribs extending transverse to the longitudinal ribs, wherein adjacent ones of the lateral ribs are longitudinally spaced apart by a second distance, the longitudinal spacing between adjacent lateral ribs of the second region being a function of the height of the ribs of the second region; and a third region contiguous to, and distal of, the second region, the third region including a plurality of third cells defined by a plurality of spaced-apart longitudinal ribs and a plurality of spaced-apart lateral ribs extending transverse to the longitudinal ribs, wherein adjacent ones of the lateral ribs are longitudinally spaced apart by a third distance, the longitudinal spacing between adjacent lateral ribs of the third region being a function of the height of the ribs of the third region;

wherein the third distance is greater than the second distance, and the second distance is greater than the first distance.

2. The shower pan of claim 1, wherein radial spacing between adjacent annular ribs of the first region, the longitudinal spacing between adjacent lateral ribs of the second region, and the longitudinal spacing between adjacent lateral ribs of the third region are a function of the height of the ribs, are defined by the formula of 1=0.3662 $h^3$, wherein 1 is spacing between ribs, and h is rib height.

3. The shower pan of claim 1, wherein:

the ribs of the first region have an average first rib height, the ribs of the second region have an average second rib height, and the ribs of the third region have an average third rib height; and the first rib height is less that the second rib height, and the second rib height is less than the third rib height.

4. The shower pan of claim 1, wherein:

adjacent ones of the radial ribs of the first region are radially spaced apart substantially by the first distance;

adjacent ones of the longitudinal ribs of the second region are longitudinally spaced apart substantially by the second distance such that the second cells define squares; and adjacent ones of the longitudinal ribs of the third region are longitudinally spaced apart substantially by the third distance such that the third cells define squares.

5. The shower pan of claim 1, further including a threshold form coupled to an edge of the body at the first region.

6. The shower pan of claim 5, wherein the threshold form includes one of a receiver and a post, and the first region includes the other of the post and the receiver, the post received within the receiver to couple the threshold to the first region.

7. The shower pan of claim 1, wherein the plurality of first cells of the first region are concentrically positioned relative to the drain opening, the plurality of second cells of the second region are polygons arranged in a rectilinear pattern, and the plurality of third cells of the third region are polygons arranged in a rectilinear pattern.

8. The shower pan of claim 1, wherein the body is a molded polymer.

9. The shower pan of claim 8, wherein the body includes a planar upper surface, and the plurality of ribs of the first region, the second region and the third region extend downwardly from the body.

10. The shower pan of claim 1, further comprising:

a fourth region contiguous to, and distal from, the third region, the fourth region including a plurality of fourth cells defined by a plurality of spaced-apart longitudinal ribs and a plurality of spaced-apart lateral ribs extending transverse to the longitudinal ribs, wherein adjacent ones of the lateral ribs are longitudinally spaced apart by a fourth distance;

wherein the radial spacing between adjacent lateral ribs of the fourth region are a function of the height of the ribs, such that the fourth distance is greater than the third distance of the third region.

11. A shower pan comprising:

a base including a substantially planar upper surface;

a first region including a drain opening extending through the base, a plurality of cells defined by a plurality of spaced-apart annular ribs extending downwardly from the base, and a plurality of spaced apart radial ribs extending downwardly from the base and intersecting the annular ribs;

wherein the plurality of cells of the first region are concentrically positioned relative to the drain opening;

a second region including a plurality of cells defined by a plurality of spaced-apart longitudinal ribs extending downwardly from the base, and a plurality of spaced-apart lateral ribs extending downwardly from the base and transverse to the longitudinal ribs;

wherein the plurality of cells of the second region are polygons arranged in a rectilinear pattern; and wherein the spacing between adjacent annular ribs of the first region are a function of the height of the annular ribs of the first region, and the spacing between adjacent lateral ribs of the second region are a function of the height of the lateral ribs of the second region, such that the spacing of the ribs of the first region is less than the spacing of the ribs of the second region.

12. The shower pan of claim 11, wherein the spacing between adjacent annular ribs of the first region and the spacing between adjacent lateral ribs of the second region are defined by the formula of 1=0.3662 $h^3$, wherein 1 is spacing between ribs, and h is rib height.

13. The shower pan of claim 11, wherein the base includes a peripheral edge, and a threshold form coupled to the peripheral edge of the base at the first region.

14. The shower pan of claim 13, wherein the threshold form includes one of a receiver and a post, and the first region includes the other of the post and the receiver, the post received within the receiver to couple the threshold to the first region.

15. The shower pan of claim 11, wherein the plurality of ribs extend downwardly from the base.

16. The shower pan of claim 15, wherein the base and the plurality of ribs are integrally formed from a polymer.

17. A shower pan comprising:

a first region including a drain opening, a plurality of cells defined by a plurality of spaced-apart annular ribs, and a plurality of spaced-apart radial ribs intersecting the annular ribs;

wherein the spacing between adjacent annular ribs is a function of the height of the ribs, such that the spacing between adjacent annular ribs is defined by the relationship of 1=C $h^3$, wherein 1 is spacing between adjacent ribs, h is rib height, and C is a reference constant; and wherein the plurality of cells of the first region are concentrically positioned relative to the drain opening.

18. The shower pan of claim 17, further comprising:

a second region including a plurality of cells defined by a plurality of spaced-apart longitudinal ribs extending downwardly from the base, and a plurality of spaced-apart lateral ribs extending downwardly from the base and transverse to the longitudinal ribs;

wherein the plurality of cells of the second region are polygons arranged in a rectilinear pattern; and wherein the spacing between adjacent annular ribs of the first region and the spacing between adjacent lateral ribs of the second region are a function of the height of the ribs such that the spacing of the ribs of the first region is less than the spacing of the ribs of the second region.

19. The shower pan of claim 11, further comprising:

a base, wherein the base includes a peripheral edge; and a threshold form coupled to the peripheral edge of the base at the first region.

20. The shower pan of claim 19, wherein the threshold form includes one of a receiver and a post, and the first region includes the other of the post and the receiver, the post received within the receiver to couple the threshold to the first region.

21. The shower pan of claim 17, further comprising a base including a substantially planar upper surface, wherein the plurality of ribs extend downwardly from the base.

22. The shower pan of claim 21, wherein the base and the plurality of ribs are integrally formed from a polymer.

23. The shower pan of claim 17, wherein the reference constant C is substantially equal to 0.3662.

* * * * *